US005987892A

United States Patent [19]

Watanabe et al.

[11] Patent Number: 5,987,892

[45] Date of Patent: Nov. 23, 1999

[54] STORAGE BOX APPARATUS

[75] Inventors: Hideo Watanabe, Kawasaki; Fumikazu Kiya, Noboribetsu, both of Japan

[73] Assignee: Thermovonics Co., Ltd., Kanagawa, Japan

[21] Appl. No.: 08/997,819

[22] Filed: Dec. 24, 1997

[30] Foreign Application Priority Data

Dec. 27, 1996 [JP] Japan ..... 8-350848

[51] Int. Cl.[6] ..... F25B 21/02

[52] U.S. Cl. ..... 62/3.7; 62/3.3; 62/3.6; 62/259.2; 62/434

[58] Field of Search ..... 62/3.2, 3.3, 3.6, 62/3.7, 259.2, 434

[56] References Cited

U.S. PATENT DOCUMENTS

| | | | |
|---|---|---|---|
| 3,220,198 | 11/1965 | Muller | 62/3 |
| 3,252,504 | 5/1966 | Newton | 165/2 |
| 5,349,831 | 9/1994 | Daikoku | 62/376 |
| 5,515,683 | 5/1996 | Kessler | 62/3.7 |
| 5,713,208 | 2/1998 | Chen | 62/3.7 |
| 5,737,923 | 4/1998 | Gilley | 62/3.7 |

FOREIGN PATENT DOCUMENTS 3-13504 2/1991 Japan .

*Primary Examiner*—Henry Bennett
*Assistant Examiner*—Melvin Jones
*Attorney, Agent, or Firm*—Evenson, McKeown, Edwards & Lenahan, P.L.L.C.

[57] ABSTRACT

A storage box apparatus makes use of thermoelectric modules as devices for cooling or heating storage units, respectively. Each thermoelectric module is provided with a heat-dissipating-side base and a heat-absorbing-side base. A liquid heat transfer medium is spouted against a surface of the heat-dissipating-side base substantially at a right angle.

11 Claims, 18 Drawing Sheets

STORAGE BOX APPARATUS

BACKGROUND OF THE INVENTION a) Field of the Invention

This invention relates to a storage box apparatus, which can be arranged, for example, in a detached house, a multiple dwelling house such as a condominium, a business building, a department store, a station, an airport or the like and can be used, for example, for keeping something delivered by a delivery serviceman of a home delivery service company, liquor store, laundry or the like or when a user sends out a package. In particular, the present invention is concerned with a storage box apparatus provided with one or more thermoelectric modules for enabling refrigeration, freezing and heating of one or more packages during storage.

b) Description of the Related Art

A system has been developed recently, in which a storage box apparatus is arranged in a multiple dwelling house such as a condominium. If no one is at a consignee's house when a home delivery serviceman visits there, he leaves a package in the storage box apparatus and also drops a delivery slip in a mail box of the consignee's house. When the consignee returns home, the consignee learns the delivery of the package from the delivery slip and then receives the package from the storage box apparatus.

Known examples of the storage box apparatus for use in the above system include those making use of flon and a compressor like ordinary electric refrigerators and those provided with refrigerating function by using a thermoelectric module.

However, those making use of a flon-type cooling medium involve an environmental problem such as ozone layer depletion by flon. Further, storage box apparatuses making use of flon and a compressor take long time until cooling is performed in an intermittent operation after they are kept out of operation for a relatively long time, because they first require a pre-stage of gas compression after they are switched on. Accordingly, a cooling system making use of one or more thermoelectric modules has been developed recently. As this system does not use flon gas, it has many advantages such that it is free from environmental disruption, it is excellent in cooling performance, it is free from the potential problem of gas leakage, it can be constructed into a smaller size with a longer service life owing to the use of semiconductors as primary components, and it does not require the pre-stage of gas compression and can immediately perform cooling upon energization.

FIG. 26 is a cooling characteristic diagram showing temperature control of a storage box apparatus of the flon/compressor type (preset interior temperature: +2.5° C., curve X) and also temperature control of a storage box apparatus making use of a thermoelectric module (preset interior temperature: −0.2° C., curve Y).

As is evident from this diagram, the cooling box apparatus of the flon/compressor type requires a substantial time until the preset temperature is reached after the temperature control is started, and during the temperature control, the interior temperature varies up and down considerably. In contrast, the storage box apparatus making use of the thermoelectric module reaches the preset temperature in a short time after the temperature control is started, and the interior temperature is then held practically constant, thereby leading to an advantage that the accuracy of the temperature control is good.

Storage box apparatuses making use of one or more thermoelectric transducers of the above-described type are conventionally known as they are disclosed, for example, in Japanese Patent Application Laid-Open (Kokai) No. SHO 64-80321 and Japanese Patent Application Laid-Open (Kokai) No. HEI 7-101492.

Depending of the place of installation, these storage box apparatuses may however be brought under substantially the same temperature environment as the external air. They are generally provided with rather thin heat-insulating layers in view of their installation spaces and moreover, the interiors have been in a hermetically-closed state before packages are placed. The interiors are considerably hot especially in summer during which the temperature of the external air is high.

A perishable such as meat is placed in the interior of such a hot temperature, and the power switch for the thermoelectric module is turned on. Since a conventional storage box apparatus is air-cooled on a heat-dissipating side, its interior cannot be cooled rapidly and moreover, tends to be affected by the external temperature, whereby its refrigerating function or freezing function cannot be exhibited to full extent. It is therefore accompanied by a drawback such that the freshness of perishables stored inside may be lowered and, when a delivered package is stored for a long time due to a trip or the like, its perishable content may spoil, thereby giving off a bad smell.

SUMMARY OF THE INVENTION

A first object of the present invention is to eliminate such drawbacks of the conventional art and hence, to provide a storage box apparatus that the interior can be rapidly cooled or heated without being substantially affected by the external air and function such as refrigeration, freezing, heating or the like can be exhibited surely.

A second object of the present invention is to provide a storage box apparatus which requires a smaller number of parts, permits a dimensional reduction and also allows reductions in manufacturing cost and power consumption.

To achieve the first object, the present invention provides in a first aspect thereof a storage box apparatus making use of a thermoelectric module as a device for cooling or heating a storage unit, said thermoelectric module being provided with a heat-dissipating-side base and a heat-absorbing-side base, wherein a liquid heat transfer medium, for example, water is spouted against a surface of the heat-dissipating-side base or heat-absorbing-side base substantially at a right angle.

To attain the second object, the present invention provides in a second aspect thereof a storage box apparatus making use of plural thermoelectric modules as devices for cooling or heating corresponding storage units, said thermoelectric modules being provided with heat-dissipating-side bases and heat-absorbing-side bases, respectively, wherein a heat transfer medium recirculating system is arranged for supplying a liquid heat transfer medium to the heat-dissipating-side bases or heat-absorbing-side bases while recirculating the liquid heat transfer medium through the heat-dissipating-side bases or heat-absorbing-side bases, and a heat-dissipating unit or heat-absorbing unit for the heat transfer medium is arranged outside the plural thermoelectric modules for use commonly by the plural thermoelectric modules.

According to the first aspect of the present invention, a thermoelectric module is used and a liquid heat transfer medium is spouted against a surface of a base, as described above. As the liquid heat transfer medium is assured to be in a turbulent state when it is brought into contact with the base, transfer of heat is efficiently achieved. As a result, the efficiency of a heat exchange is improved. It is therefore possible to provide a storage box apparatus which can promptly cool the interior of a storage unit without being affected by the temperature of external air, can surely exhibit functions such as refrigeration and freezing, and has high reliability even when used for keeping contents warm.

According to the second aspect of the present invention, a heat-dissipating or heat-absorbing device for a heat transfer medium, said device being arranged outside plural thermoelectric modules, is commonly used by the plural thermoelectric modules as described above. Accordingly, fewer parts are required for the heat-dissipating or heat-absorbing device which includes, for example, a radiator, a fan and a pump. It is therefore possible to provide a storage box apparatus which can be reduced in size, manufacturing cost and power consumption.

BRIEF DESCRIPTION OF THE DRAWINGS

FIG. 23 is a plan view of a heat-dissipating-side base for use in the storage box apparatus according to the seventh embodiment;

DETAILED DESCRIPTION OF THE INVENTION AND PREFERRED EMBODIMENTS

The preferred embodiments of the present invention will hereinafter be described with reference to the drawings.

Referring first to FIGS. 1 to 12, the first embodiment of the present invention will be described.

Figure 2:
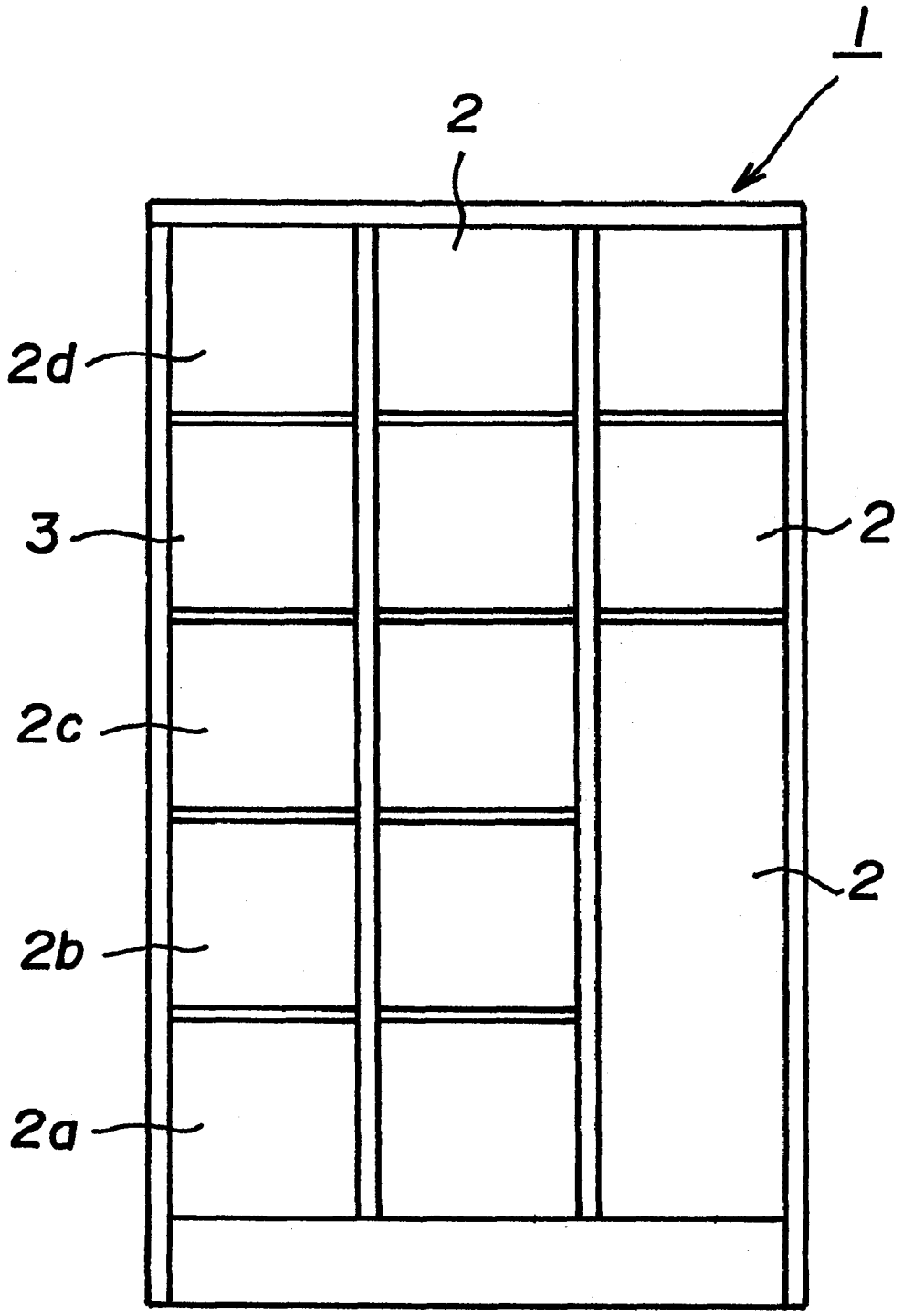
FIG. 2 is a front view of the storage box apparatus.
Figure 3:
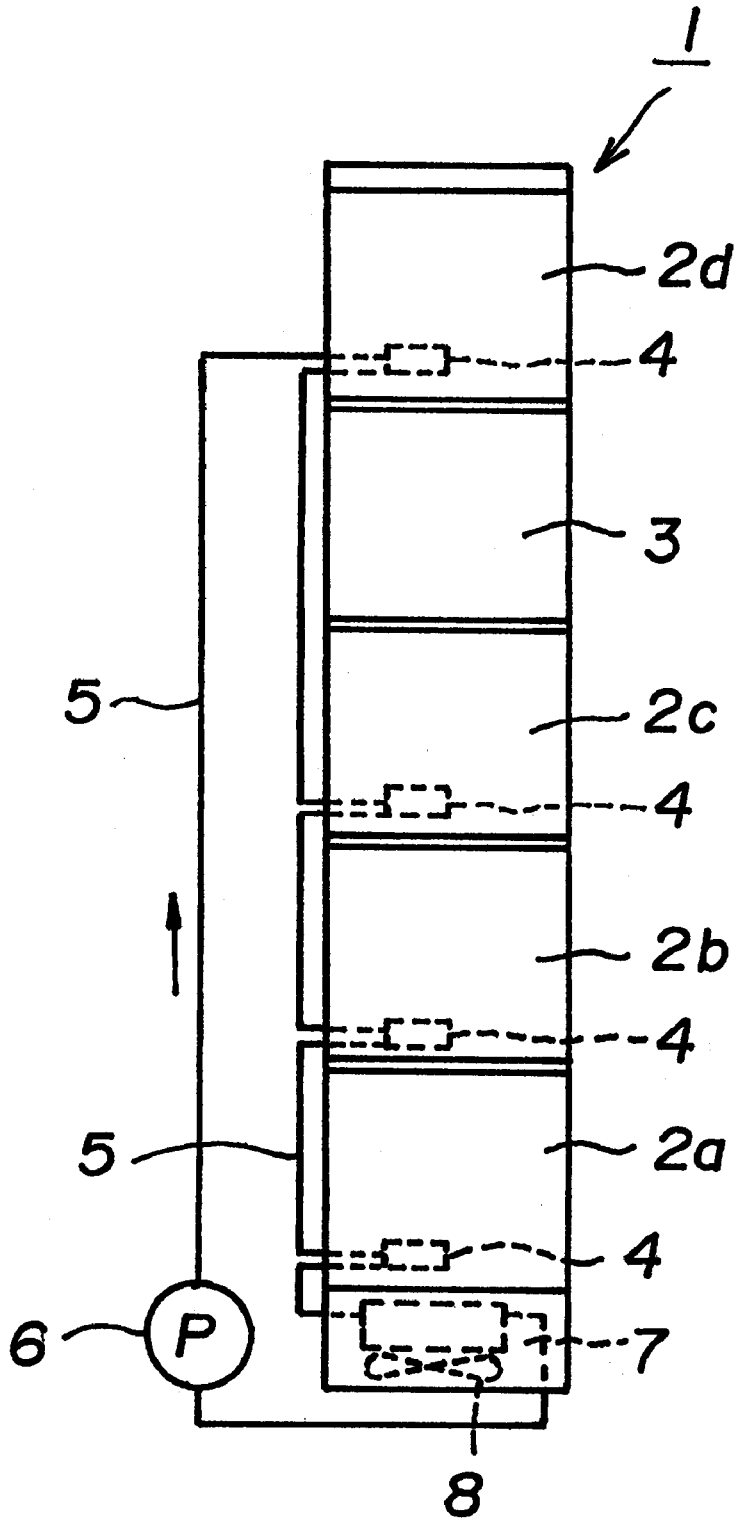
FIG. 3 is a side view of the storage box apparatus.

As is illustrated in FIGS. 2 and 3, a storage box apparatus 1 is constructed primarily of an assembly in which a number of storage units 2 and one operation control unit 3 are arranged in a stage-and-column relationship. Among the storage units 2, the lefthand-side vertical column as viewed in FIG. 2, for example, consists of the storage units 2*a*–2*d*, which are lined with heat barriers and are equipped with refrigerating/freezing function. Of these storage units, the storage unit 2*a*,2*b* which are in the first and second stages, respectively, as counted from the bottom permit switching between frozen storage and refrigerated storage, whereas the storage units 2*c*,2*d* in the third and fifth stages permit refrigerated storage. These storage units 2*a*–2*d* can also be used as room-temperature storage units when they are not energized.

Although not illustrated in the drawings, the operation control unit 3 is provided with a timer-equipped printer for issuing receipts, a voice output device and display for instructing operation procedures, a card reader for IC cards, magnetic cards or the like, a numeric key pad, a selector key for frozen storage or refrigerated storage, a model and the like, all in a built-in fashion. Each storage unit 2 is of the automated locking system, and an operation of the numeric key pad of the operation control unit 3 makes it possible to unlock the storage unit 2. In addition, a temperature during frozen storage or refrigerated storage can be set by operating the numeric key pad. This temperature setting can be made either stepwise or linearly. Each of the storage units 2*a*–2*d* is designed to display an indication of "frozen storage" or "refrigerated storage".

Incidentally, the temperature control is performed in different modes, one being applied when each storage unit 2 is used for frozen storage, and the other when each storage unit 2 is used for refrigerated storage. Depending on their use, one of these temperature control modes is selectively set by the operation control unit 3.

Arrangement of the operation control unit 3 in a manner replaceable by another operation control unit is economically advantageous, because the replacement of the operation control unit 3 by the another operation control unit is sufficient without replacement of the entire apparatus including the storage units 2 when the operation control unit 3 is subjected to a version-up or becomes out of order.

In this embodiment, the single operation control unit 3 is arranged for the storage units 2*a*–2*d*. As an alternative, each storage unit can be provided with its own operation controller.

As is shown in FIG. 3, the storage units 2*a*–2*d* are provided with thermoelectric modules 4, respectively. These individual thermoelectric modules are connected together through a water-distributing pipe, in which a radiator 7 and a recirculating pump 6 are arranged. A fan 8 is disposed in the vicinity of the radiator 7. Each of the thermoelectric modules 4 may be provided with its own radiator although one radiator 7 is arranged for the plural thermoelectric modules 4 in this embodiment.

Reference will next be had to FIGS. 4 through 7. As is shown, for example, in FIG 4, each of the storage units 2*a*–2*d* defines a storage space 15 (see FIGS. 6 and 7) by a peripheral wall 12 having heat barriers, a door 13 equipped with a heat barrier and adapted to openably close an inlet/outlet in a front wall, and a bottom wall 14 having a heat barrier (see FIG. 6). Under light resilient force, the door 13 is biased in a direction in which the door is normally kept close, whereby the door 13 reduces an entry of heat into the storage space 15 as much as possible. A glass sheet may be fitted in the door 13 so that the state of the interior can be seen from the outside through the door.

Figure 4:
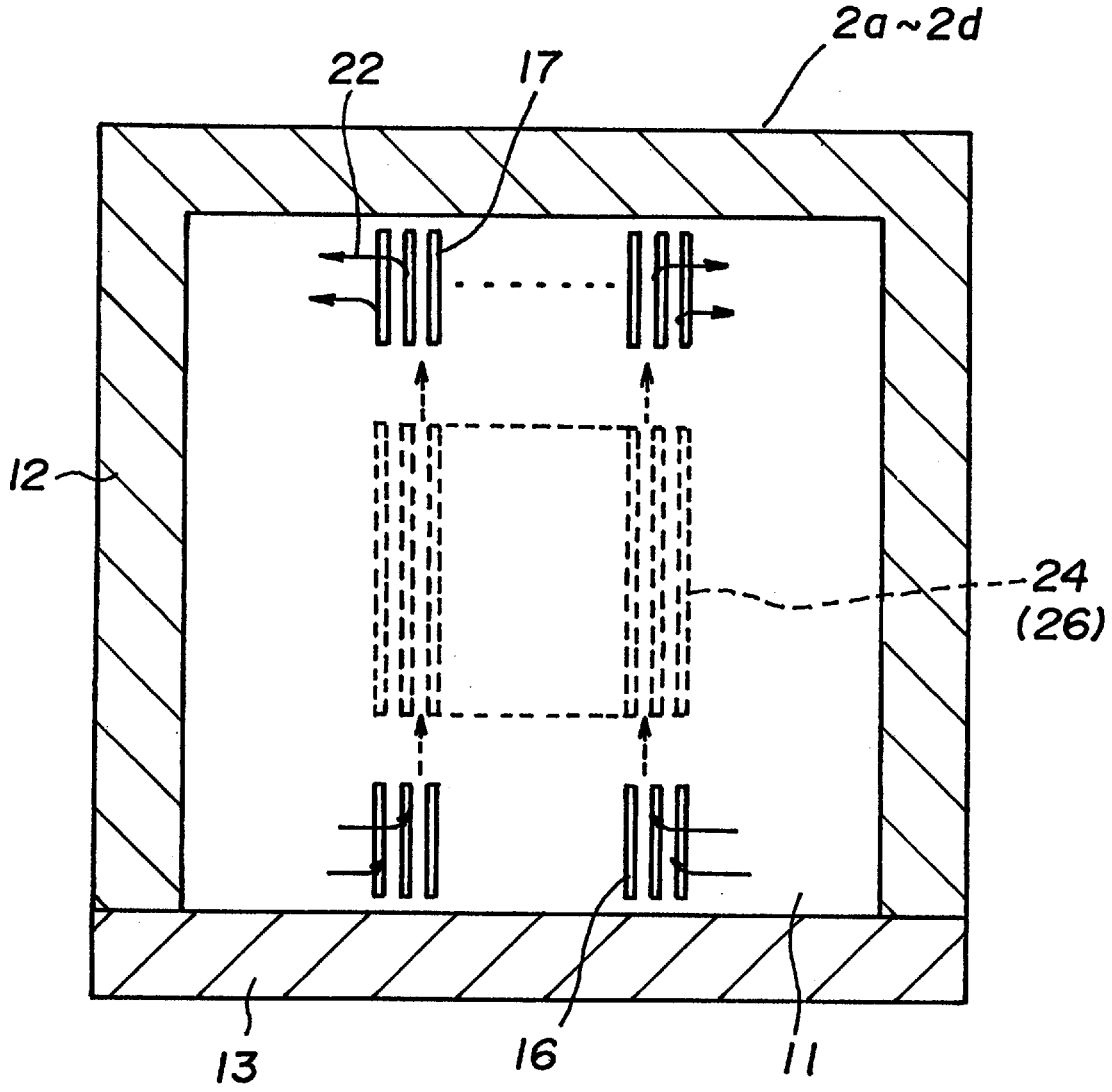
FIG. 4 is a partly cross-sectional plan view of the storage box apparatus with an intermediate plate disposed therein.
Figure 5:
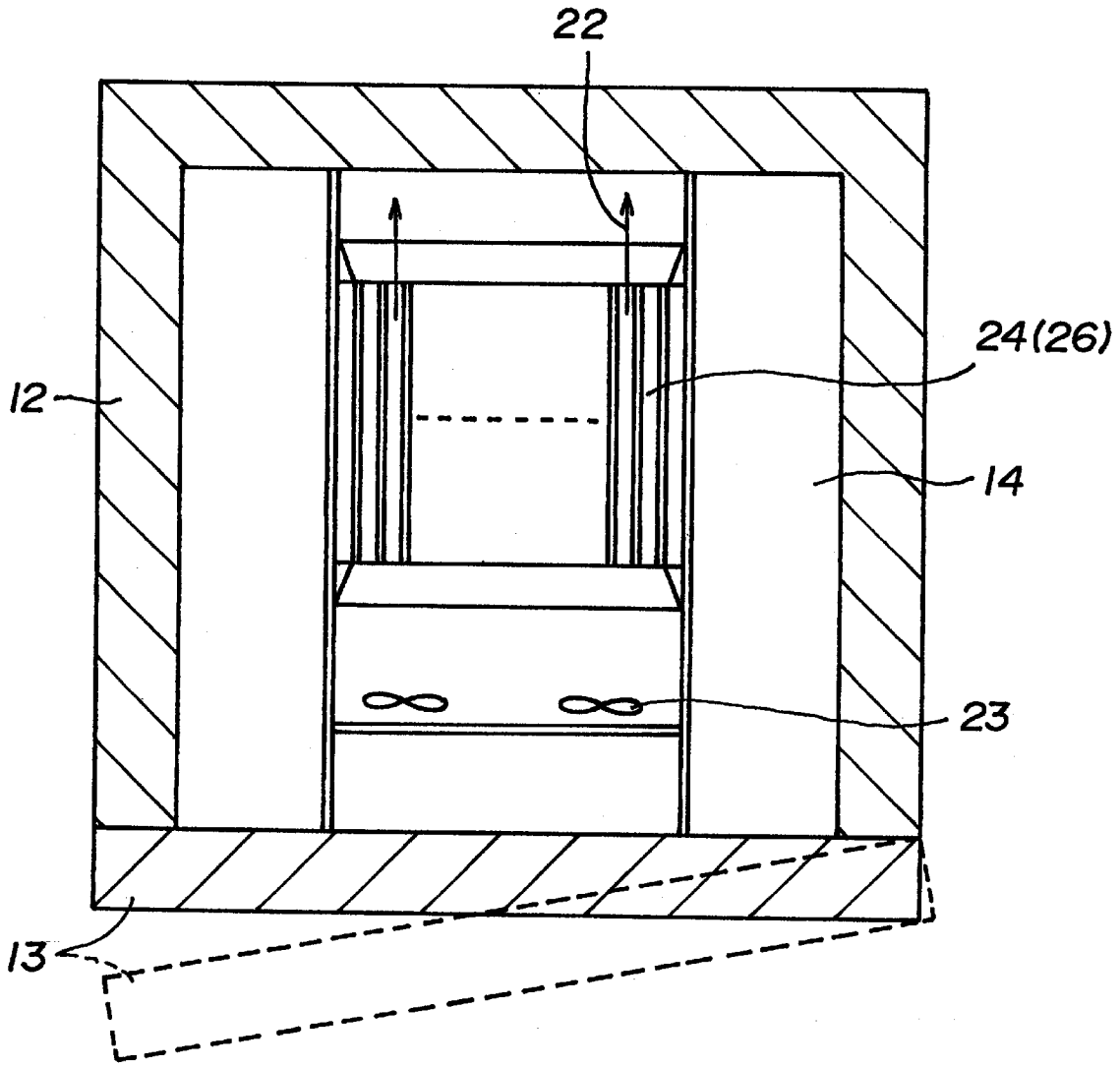
FIG. 5 is a partly cross-sectional plan view of the storage box apparatus without the intermediate base.
Figure 6:
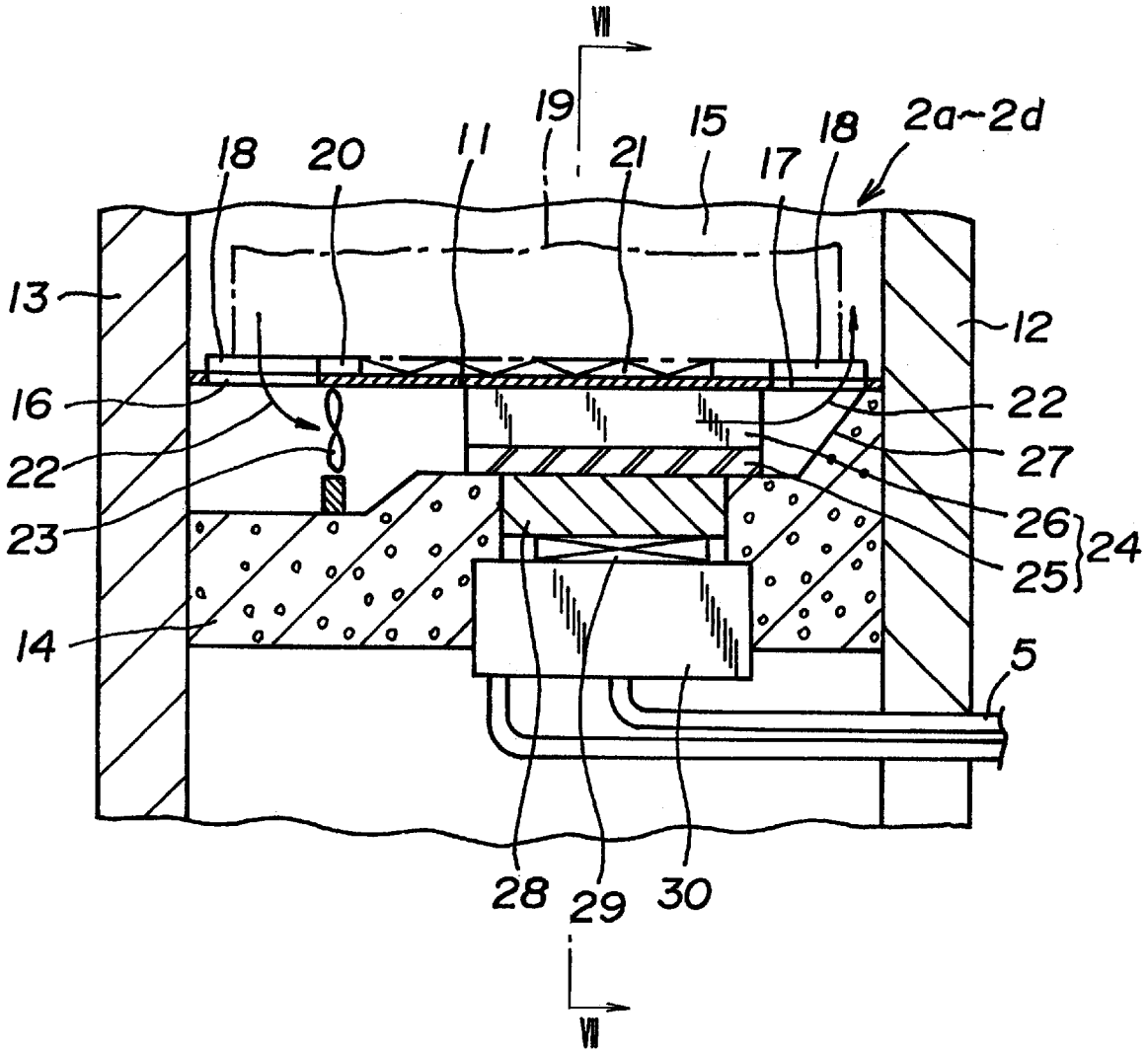
FIG. 6 is a vertical cross-sectional view of a bottom part of the storage box apparatus.
Figure 8:
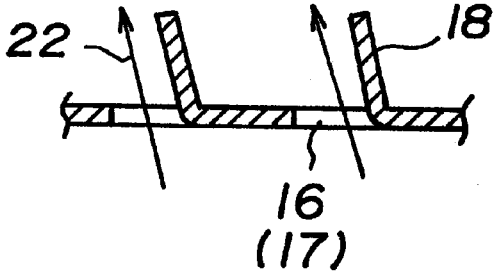
FIG. 8 is an enlarged fragmentary cross-sectional view of the intermediate base used in the storage box apparatus.

An intermediate base 11 is arranged in each of the storage units 2*a*–2*d* and is constructed of a metal plate or a synthetic resin plate. As is shown in FIG. 4, the intermediate base has substantially the same area as that defined by the peripheral wall 12 and the door 13. Through the intermediate base 11, an inlet 16 is formed on a side of the door 13 and an outlet 17 is formed on an opposite side. In this embodiment, the inlet 16 and the outlet 17 are each in the form of a slit. As is illustrated in FIGS. 6 and 8, louvers 18 are arranged adjacent the inlet 16 and the outlet 17, respectively, whereby the louvers 18 extend into the storage space 15. Owing to the arrangement of these louvers 18, a space 20 which permits a flow of air therethrough is formed between the intermediate base 11 and contents 19 mounted on the intermediate base. In this embodiment, a spacer 21 which permits a flow of air therealong—such as a corrugated plate or a ribbed sheet, for example—is arranged over a substantially central part of the intermediate base 11 so that, even when the contents 19 are small, chilled air 22 is also allowed to flow between the intermediate base 11 and the contents 9. This spacer 21 can be arranged not on a bottom wall but also on a side wall. It is the function of the spacer 21 to improve recirculation of the chilled air 22 and, when water condensed through the formation of dew remains on the bottom wall or bottom wall, also to protect the contents from becoming wet by separating the contents from the bottom wall or the side wall. It is also desired to form concavities such as a groove at an appropriate place in the interior so that dew water can be collected. Further, drainage means can be arranged to discharge dew water out of the system.

Slight inclination of the louvers 18 toward the peripheral wall 12 as shown in FIG. 8 can contribute to spreading of the chilled air 22 inside the storage space 15. The inlet 16 and the outlet 17 are each arranged in the form of the slit in this embodiment. As an alternative, two large openings may be arranged for the reduction of air resistance, or the inlet and the outlet may be formed in another shape such as a circular hope.

As is depicted in FIG. 6, an interior fan 23 and a heat-absorbing fin member 24 are arranged between the intermediate base 11 and the bottom wall 14. The heat-absorbing fin member 24 is made, for example, of a metal having good thermal conductivity such as aluminum and is constructed of a fin base 25 and curved fins 26 arranged upright in a large number on the fin base 25. The fins 26 are positioned facing the interior fan 23, and extend from the side of the inlet 16 toward the side of the outlet 17. The fins 26 used in this embodiment are in the form of thin plates. As an alternative, it is also possible to use fins of a different shape such as pin-shaped fins.

As is illustrated in FIG. 6, the interior fan 23 is arranged near the inlet 16 in the intermediate base 11, and at a portion of the bottom wall 14 where the bottom wall faces the outlet 17 in the intermediate base 11, the bottom wall 14 is provided with an inclined surface 27 for guiding the chilled air 22 toward the outlet 17. When the interior fan 23 is rotated, the chilled air 22 efficiently cools the contents by traveling through such a recirculation route that it flows between the fins 26, passes through the outlet 17 while being guided by the inclined surface 27, spreads in the storage space 15, cools the contents 15, passes on the side of the door 13, and flows in on the side of the interior fan 23 by way of the inlet 16 in the intermediate base 11.

Figure 7:
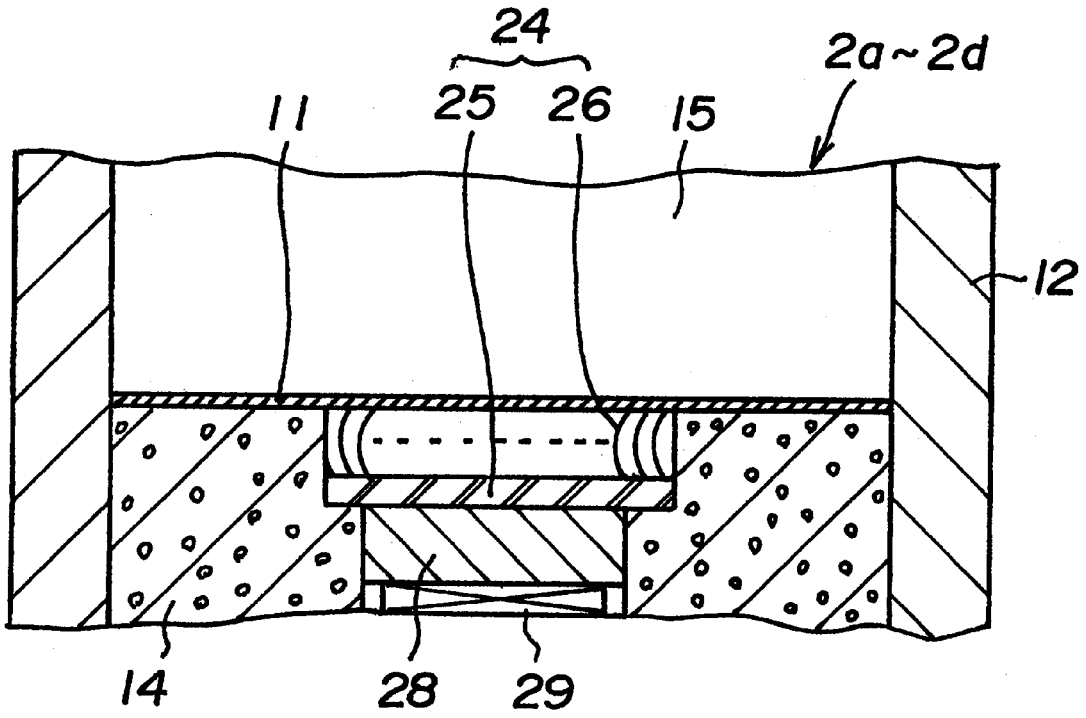
FIG. 7 is a cross-sectional view of the bottom part of the storage box apparatus, taken in the direction of arrows VII—VII of FIG. 6.

Since the fins 26 are surrounded on opposite sides thereof by the bottom wall 14 and are covered on an upper side thereof by the intermediate base 11 as illustrated in FIG. 7, the chilled air 22 from the interior fan 23 is blown in its entirety against the fins 26 so that efficient absorption of heat is carried out.

As is depicted in FIG. 6, a group of thermoelectric chips 29 is arranged underneath the heat-absorbing fin member 24 in such a way that the thermoelectric chip group 29 is in close contact with the heat-absorbing fin member 24 via a heat-absorbing-side base 28. On a lower side of the thermoelectric chip group 29, a heat-dissipating jacket 30 with a built-in, heat-dissipating-side base 31 (see FIG. 1) is attached.

The heat-absorbing-side base 28 and the heat-dissipating-side base 31 are both formed of metal plates of aluminum or the like, for example, and are provided with electrically-insulating thin films such as anodized alumina films on surfaces where the heat-absorbing-side base 28 and the heat-dissipating-side base 31 are in contact with the thermoelectric chip group 29. Upon formation of the insulating films of anodized alumina by anodization, omission of sealing treatment to the insulating thin films can provide the insulating films with better bondability with the thermoelectric chip group 29. In addition to anodization, these electrically-insulating films can also be formed by thermal spraying or the like.

Figure 1:
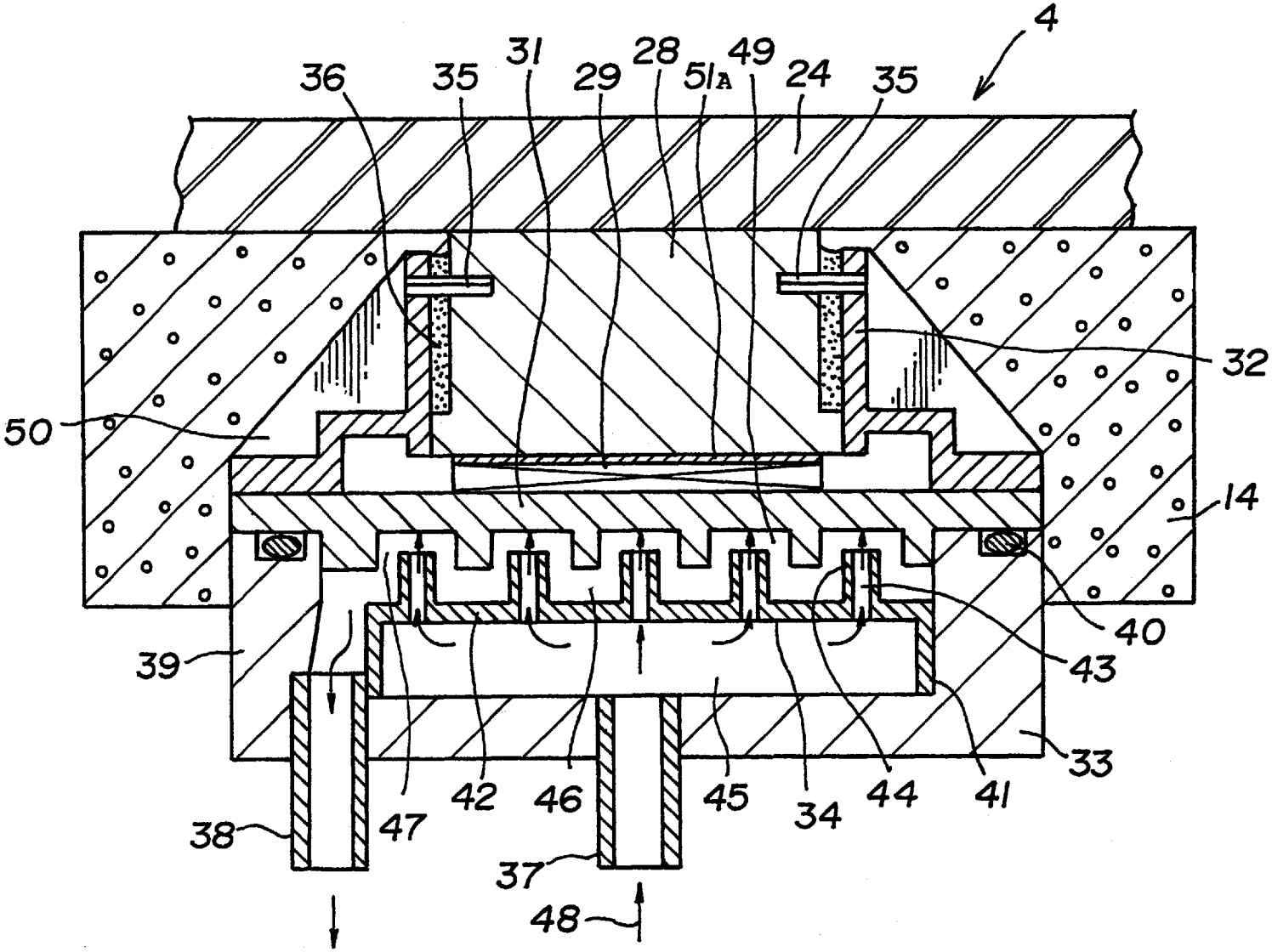
FIG. 1 is a cross-sectional view of a thermoelectric module arranged in a storage box apparatus according to a first embodiment of the present invention.

FIG. 1 is a cross-sectional view of the thermoelectric module 4. The thermoelectric module 4 is composed primarily of the heat-absorbing fin member 24, the heat-absorbing-side base 28, the thermoelectric chip group 29 and the heat-dissipating-side base 31, all of which have been described above, as well as a support frame 32, a cover member 33 and a distributing member 34.

The support frame 32 is molded of a synthetic resin and supports the heat-dissipating-side base 31. At a basal end of the support frame, the support frame is positioned by pins 35 relative to the heat-absorbing-side base 28 and is fixedly secured with adhesive layers 36 on the heat-absorbing-side base 28.

The cover member 33 is molded of a synthetic resin and is integrally provided with a supply pipe 37 and a drain pipe 38. The supply pipe 37 is arranged substantially at a central part of the cover member 33, while the drain pipe 38 is disposed in the vicinity of a peripheral edge of the cover member 33. The cover member 33 is provided with an upwardly-open peripheral wall 39. On an inner side of the upwardly-open peripheral wall, the distributing member 34 is arranged. The peripheral wall 39 is bonded in a liquid tight fashion at an upper end thereof with a peripheral portion of the heat-dissipating-side base 31 via an O-ring 40. Incidentally, liquid-tight sealing is feasible with an adhesive alone without using the O-ring 40.

The distributing member 34 is also molded of a synthetic resin and is provided at an outer periphery thereof with a pendant wall portion 41. From a top wall portion 42 of the distributing member, a number of nozzle portions 44 with jet nozzles 43 formed therein extend upwardly at intervals. Escape concavities are arranged close to root portions of the individual nozzle portions 44, and the individual escape concavities communicate with each other while avoiding the nozzle portions 44.

The arrangement of the distributing member 34 within the cover member 33 has resulted in the formation of a flattened first space 45 between the cover member 33 and the distributing member 34, a flattened second space of the individual escape concavities 46 between the distributing member 34 and the heat-dissipating-side base 31, and a water-collecting channel 47 on an outer side of the distributing member 34.

Upper ends of the jet nozzles 43 extend close to the surface of the heat-dissipating-side base 31, so that a clearance gap between the jet nozzles 43 and the heat-dissipating-side base 31 is about 1 to 3 mm or so. Concavities are formed in the heat-dissipating-side base 31 at portions where the heat-dissipating-side opposes the individual jet nozzles 43. In this embodiment, the heat-dissipating-side 31 with the concavities 49 formed in a large number therein is used. It is also possible to use a heat-dissipating-side base with a flat surface against which a heat transfer medium is spouted.

When water (purified water) 48 as the heat transfer medium is supplied through the central supply pipe 37, the water spreads at once in the first space 45 so that the water is spouted in a substantially perpendicular direction from the individual nozzle portions 44 toward the flat surface of the heat-dissipating-side base 31. The water 48, which has come to contact with the heat-dissipating-side base 31 and has absorbed heat therefrom, is allowed to promptly escape toward the escape concavities 46, is collected in the water-collecting channel 47, and is discharged out of the system through the drain pipe 38. As is illustrated in FIG. 3, the discharged water 48 flows through the water-distributing pipe 5, is cooled in the radiator 7 and is then used again through a recirculating system.

In FIG. 1, numeral 50 indicates reinforcing ribs arranged integrally on the support frame 32, and numeral 51A designates a thin film which is formed between the heat-absorbing-side base 28 and the thermoelectric chip group 29 and is equipped with large thermal conductivity and also with flexibility.

Figure 9:
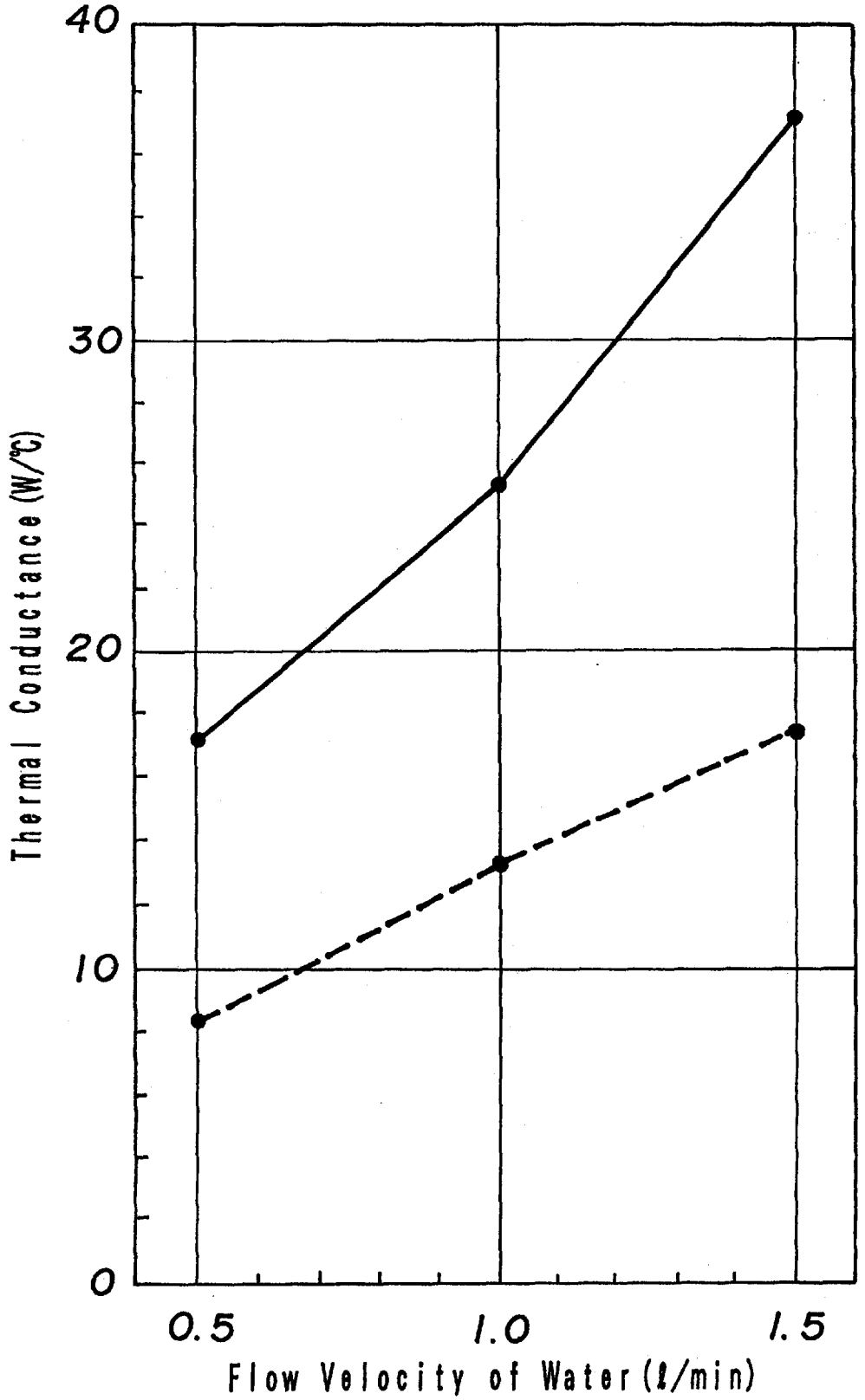
FIG. 9 is a characteristic diagram showing a relationship between the flow velocity of water and thermal conductance.

FIG. 9 illustrates relationships between the flow velocity of the water 48 and thermal conductance in a thermoelectric module making use of the heat-dissipating-side base 31 having many concavities 49 in a surface thereof as shown in FIG. 1 (solid line) and a thermoelectric module making use of a heat-dissipating-side base a surface of which is flat (dashed line).

In both apparatuses, the diameter of each jet nozzle 43 was set at 1.2 mm, the number of the jet nozzles 43 at 24, and the clearance gap between the nozzle portions 44 and the heat-dissipating-side base 31 at 2 mm. Further, the thermal conductance hA was determined by the following formula:

$$hA=Q/(T_f-(T_{in}+T_{out})/2\}\ [W/^\circ\ C.)$$

where,

Q: calorific value $T_f$: temperature of the base $T_{in}$: temperature of the water at the inlet $T_{out}$: temperature of the water at the outlet As is readily envisaged from the diagram, the thermal conductance becomes higher in both apparatuses as the flow velocity of the water 48 spouted against the heat-dissipating-side base 31 is increased. It is appreciated especially that the thermoelectric module making use of the heat-dissipating-side base having the many concavities 49 in the surface thereof (solid line) has higher thermal conductance and is superior in performance.

In this embodiment, water was used as the heat transfer medium. This invention is however not limited to the use of water, and in addition to water, other liquids such as anti-freeze can also be used.

Figure 10:
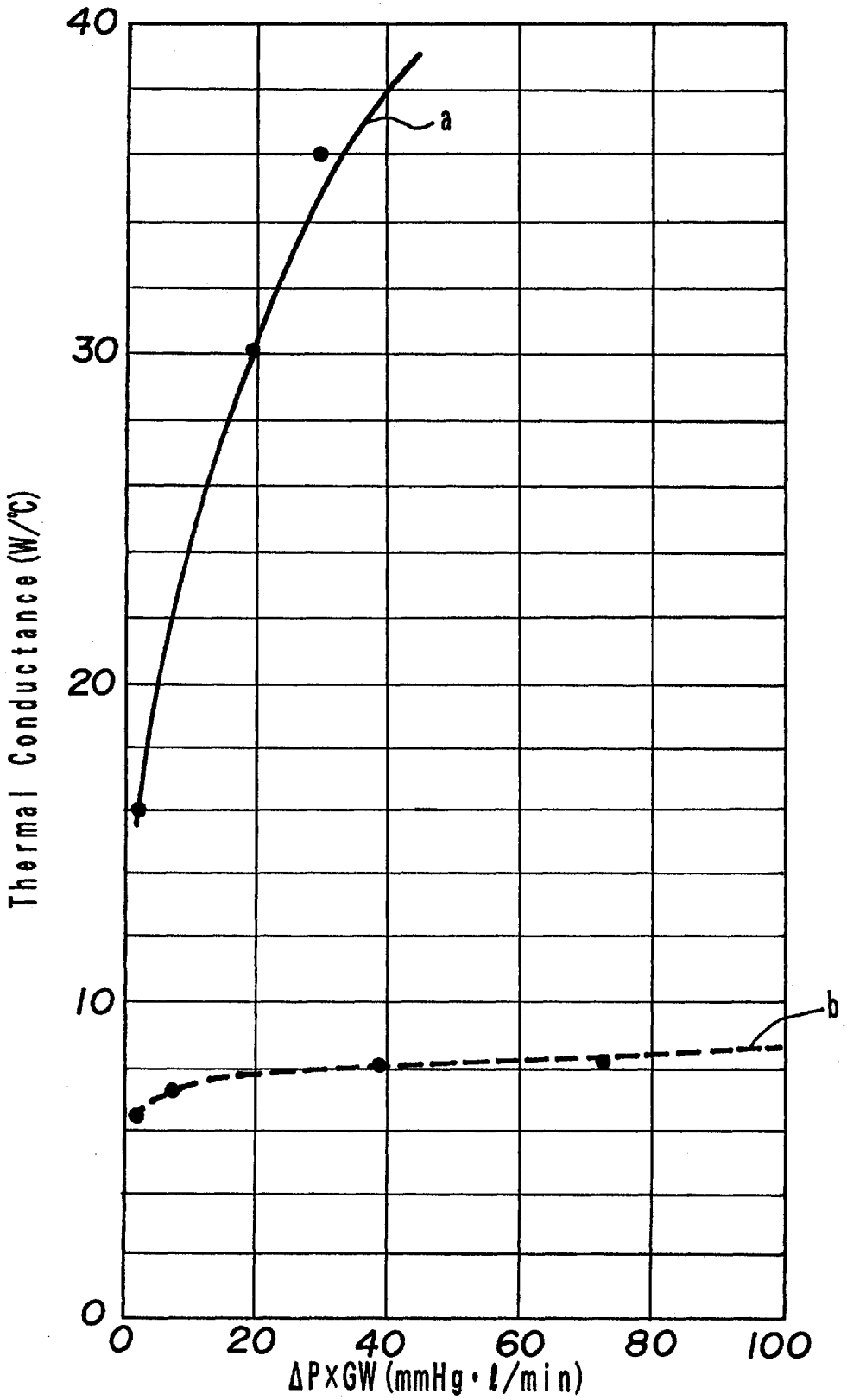
FIG. 10 is a characteristic diagram illustrating a relationship between the quantity of water and thermal conductance.

FIG. 10 is a characteristic diagram showing a relationship between the flow rate of water and thermal conductance. The flow rate of water to be supplied to a thermoelectric module at a constant electric power supply to a recirculating pump (pressure loss ΔP×flow velocity $G_w$) is plotted along the abscissa of the diagram, while thermal conductance is plotted along the ordinate. In the diagram, a curve a represents characteristics of the thermoelectric module shown in FIG. 1, which pertains to the first embodiment of the present invention, and a curve b represents characteristics of a thermoelectric module of such a structure that water is supplied to flow in a tortuous pattern along a surface of a heat-dissipating-side base (comparative example).

In the thermoelectric module of this comparative example, the water flow passage from the supply pipe to the drain pipe is narrow, and is long because it extends in the tortuous pattern while changing the direction a plurality of times. Accordingly, the water is subjected to a great pressure loss. Further, the water flows in the form of a substantially laminar flow in parallel with the surface of the heat-dissipating-side base so that the transfer of heat from the heat-dissipating-side base to the water is not very good. The thermal conductance is therefore small as shown by the curve b.

Compared with the thermoelectric module of the comparative example, the thermoelectric module in the first embodiment of the present invention (curve a) is designed to spout water against the heat transfer surface of the heat-dissipating-side base to absorb heat from the heat-dissipating-side base. In addition, the water flow passage is short and the pressure loss is small. The thermoelectric module in the first embodiment of the present invention therefore has great thermal conductance and excellent characteristics.

The thermoelectric module in the storage box apparatus according to the first embodiment of the present invention spouts the liquid heat transfer medium (for example, water) against the surface of the base as described above. Since the liquid heat transfer medium is assured to be brought as a turbulent flow into contact with the base, transfer of heat is efficiently achieved. As a result, the efficiency of heat exchange as the whole apparatus is heightened, leading to excellent performance.

Figure 11:
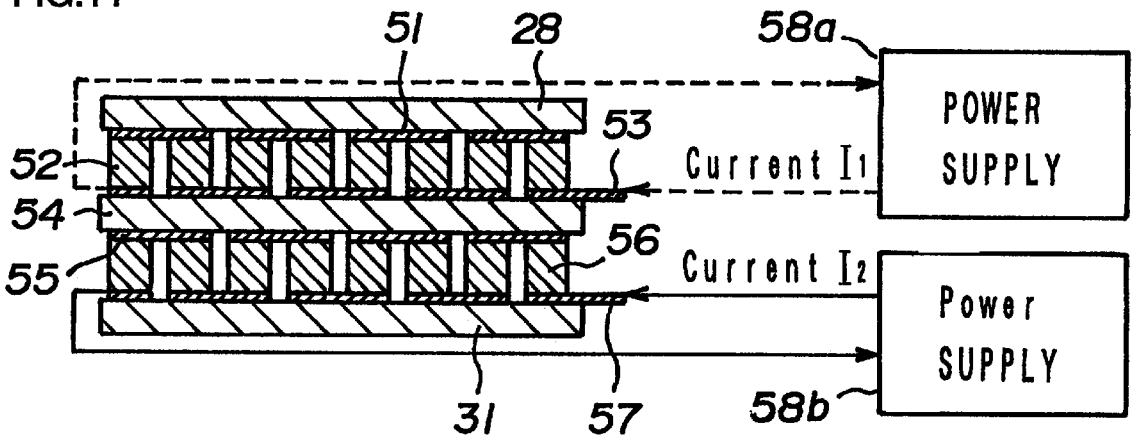
FIG. 11 is a simplified construction diagram of groups of thermoelectric semiconductor chips for use in the first embodiment.

The thermoelectric chip group 29 may be either in a single stage or in plural stages. In this embodiment, a two-stage cascade structure is adopted. FIG. 11 is a schematic construction diagram of the thermoelectric chip group 29, and shows upper-stage, heat-absorbing-side electrodes 51, a heat-absorbing-side semiconductor chip group 52 composed of P-type semiconductor chips and N-type semiconductor chips, upper-stage heat-dissipating-side electrodes 53, an intermediate substrate 54, lower-stage heat-absorbing-side electrodes 55, a heat-dissipating-side semiconductor chip group 56 composed of P-type semiconductor chips and N-type semiconductor chips, and lower-stage heat-dissipating-side electrodes 57.

In this embodiment, the heat-absorbing-side semiconductor chip group 52 and the heat-dissipating-side semiconductor chip group 56 are the same in the dimensions and number of chips used therein. This makes it possible to fabricate the heat-absorbing-side semiconductor chip group 52 and the heat-dissipating-side semiconductor chip group 56 without distinguishing them from each other, thereby bringing about a good manufacturing yield.

A power supply 58 is divided into a heat-absorbing-side power supply 58*a* and a heat-dissipating-side power supply 58*b*. The heat-absorbing-side semiconductor chip group 52 and the heat-dissipating-side semiconductor chip group 56 are independently driven by the heat-absorbing-side power supply 58*a* and the heat-dissipating-side power supply 58*b* at a current density $I_1$ (for example, 93 A/cm$^2$) and a current density $I_2$ (for example, 200 A/cm$^2$), respectively, so that the heat-dissipating-side current density $I_2$ is set higher than the heat-absorbing-side current density $I_1$ ($I_2>I_1$).

Figure 12:
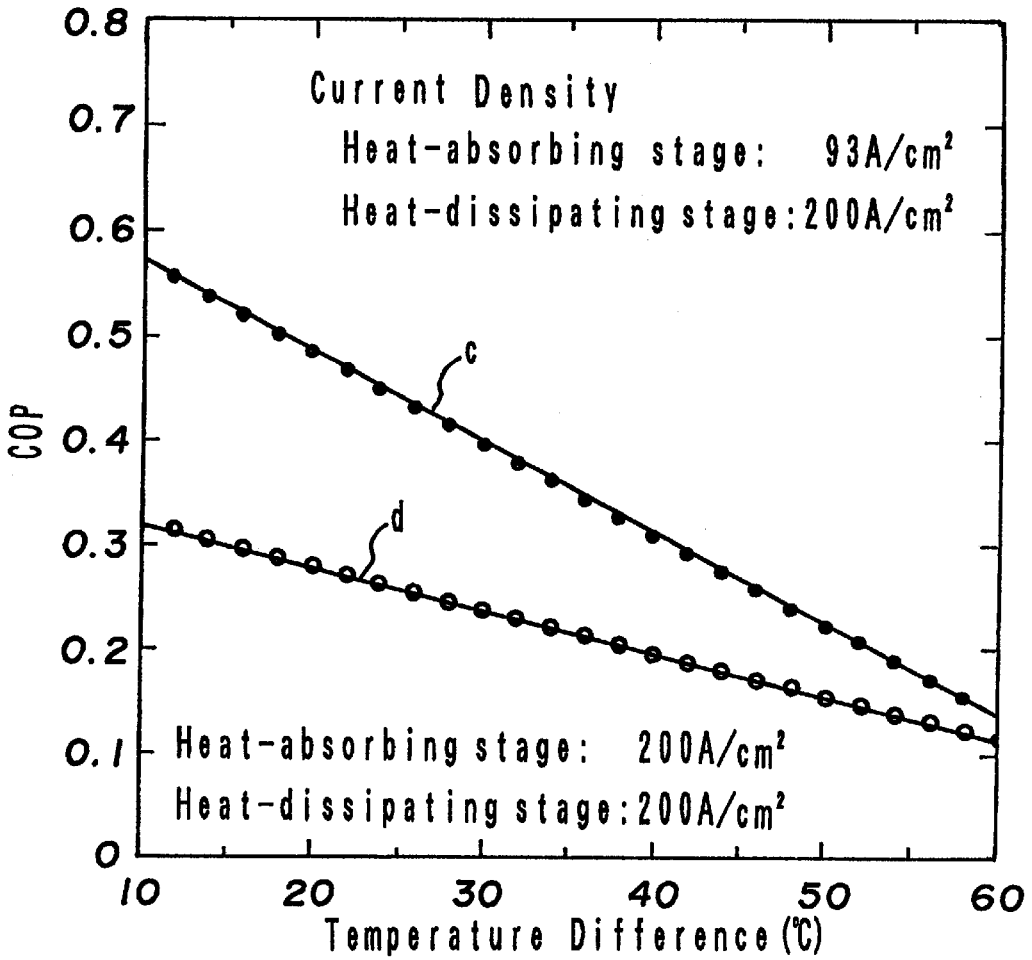
FIG. 12 is a characteristic diagram depicting a relationship between a temperature difference and COP.

FIG. 12 is a diagram showing COP characteristics of the thermoelectric module in the storage box apparatus according to this invention and a thermoelectric module in a storage box apparatus according to a comparative example. In the thermoelectric module used in the storage box apparatus according to this embodiment, the heat-absorbing-side semiconductor chip group and the heat-dissipating-side semiconductor chip group used the same semiconductor chips in the same number, in other words, the ratio of the number of chips on the heat-absorbing side to that of chips on the heat-dissipating side was set at 1:1, a current was supplied to the heat-absorbing-side chip group to achieve a current density of 93 A/cm$^2$, and another current was supplied by a different power supply to the heat-dissipating-side chip group to attain a current density of 200 A/cm$^2$.

In the thermoelectric module employed in the storage box apparatus of the comparative example, on the other hand, the same semiconductor chips were used, as a heat-absorbing-side semiconductor chip group, as many as those employed in the thermoelectric module for the storage box apparatus according to this embodiment, and a heat-dissipating-side semiconductor chip group used the same semiconductor chips three times as many as those employed on the heat-absorbing side, that is, the ratio of the number of chips on the heat-absorbing side to the number of chips on the heat-dissipating-side was set at 1:3, the heat-absorbing-side semiconductor chip group and the heat-dissipating-side semiconductor chip group were connected in series, and a current was supplied to achieve a current density of 200 A/cm$^2$.

FIG. 12 shows relationships between temperature difference ΔT and COP in both thermoelectric modules. In the diagram, line c represents characteristics of the thermoelectric module in the storage box apparatus according to this embodiment while line d represents those of the thermoelectric module in the storage box apparatus of the above-described comparative example. As is evident from this diagram, the thermoelectric module in the storage box apparatus according to this embodiment is better in thermoelectric conversion characteristics and higher in COP at the same temperature difference ΔT. In other words, the thermoelectric module in the storage box apparatus according to this embodiment can obtain a desired temperature difference with smaller consumption of supplied electric power and consequently, can reduce the running cost.

The two power supplies 58*a*,58*b* were used in the thermoelectric module in the storage box apparatus according to the above-described first embodiment. Instead, it is also possible to use a single power supply which can produce two outputs of different current densities.

Figure 13:
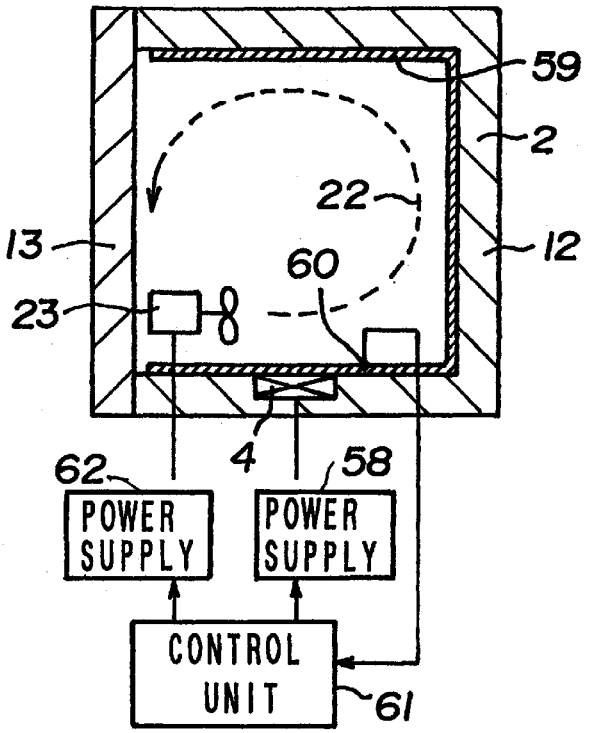
FIG. 13 is a simplified construction diagram of a storage unit in a storage box apparatus according to a second embodiment of the present invention.

Referring next to FIG. 13, the storage unit 2 in the storage box apparatus according to the second embodiment of the present invention will be described. In this embodiment, an internal box 59 which has good thermal conductivity and is made, for example, of aluminum or the like is arranged along an inner surface of a peripheral wall 12, and a temperature sensor 60 is arranged on an inner surface of the internal box 59. A detection signal from the temperature sensor 60 is inputted to a control unit 61, from which control signals are outputted to a power supply 58 for a thermoelectric module 4 and a power supply 62 for an interior fan 23.

As the interior temperature is high shortly after an initiation of energization of the thermoelectric module 4, the high interior temperature is detected by the temperature sensor 60 and based on a detection signal from the temperature sensor, the control unit 61 outputs a control signal so that large electric power is supplied from the power supply 58 to the thermoelectric module 4.

As a result, the temperature rapidly drops in the internal box 59 especially around the location where the thermoelectric module 4 is arranged, whereby the temperature tends to drop below a temperature at which moisture freezes. If the temperature continues to drop, the moisture in the interior air is converted into dew on the inner surface of the internal box 59 and the dew is then frozen. As a consequence, the relative humidity in the internal box 59 is close to 100% in the vicinity of the location where the thermoelectric module 4 is arranged, but becomes very low in a region where the temperature is higher (for example, about 3° C.) than that in the vicinity of the above-described location. The interior is therefore not under a preferred storage environment when perishables are stored, because low humidity promotes a reduction in freshness.

In this embodiment, the electric power to be supplied to the interior fan 23 is therefore increased at a time point shortly before reaching a temperature at which moisture would be frozen, while monitoring the surface temperature of the internal box 59 around the location where the thermoelectric module 4 is arranged. As a result, the linear velocity of chilled air 22 becomes higher so that the thermal conductance of the internal box 59 becomes higher. This eliminates freezing of moisture on the surface of the internal box 59, thereby making it possible to keep the interior humidity high and hence to avoid a reduction in the freshness of the contents.

High-speed rotation of the interior fan 23 may be either continuous or intermittent. If the interior fan is rotated at a high speed for an excessively long time, however, the power consumption however becomes large and the storage of perishables is deleteriously affected. It is therefore desired to limit the time of high-speed rotation to such a length as permitting maintenance of temperature and humidity at desired values and then either to return to rated operation (low-speed rotation) or to stop the interior fan.

In this embodiment, the internal box 59 was constructed of flat plates as shown in FIG. 13. If the plate thickness of the internal box 59 is reduced with a view to lowering the heat mass (calorific capacity), the use of such flat plates results in lowered mechanical strength. It is therefore desired to parallelly arrange many ribs at predetermined intervals or to form the internal box 59 by using thin plates formed in a wavy shape such as continuously corrugated plates.

Figure 14:
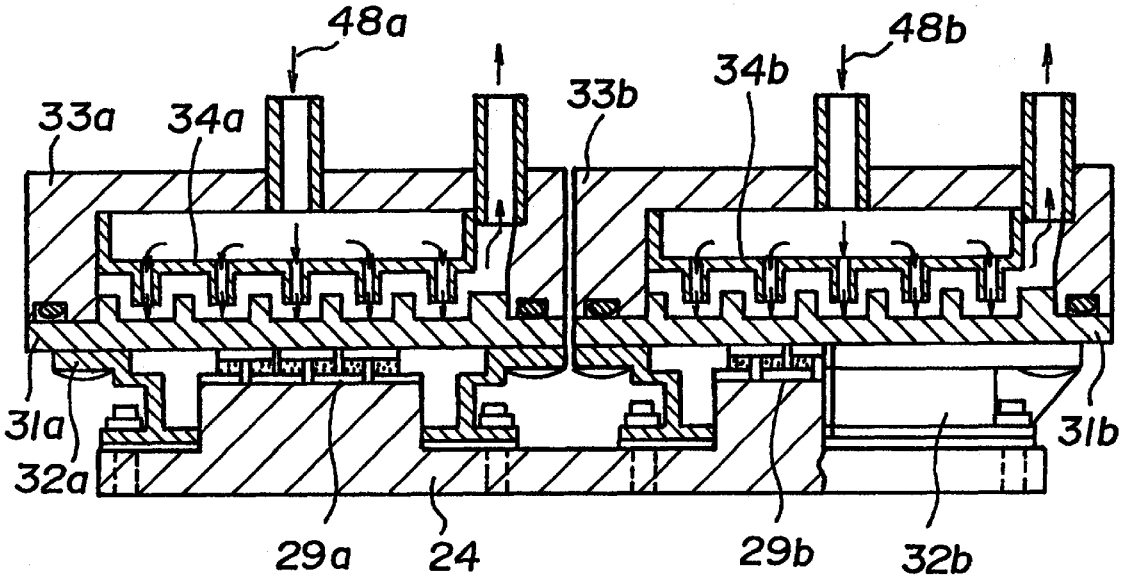
FIG. 14 is a cross-sectional view of a thermoelectric module in a storage box apparatus according to a third embodiment of the present invention.

With reference to FIG. 14, the thermoelectric module in the storage box apparatus according to the third embodiment of the present invention will hereinafter be described. A first difference of this embodiment from the thermoelectric module in the storage box apparatus according to the first embodiment as shown in FIG. 1 resides in that in combination with a single heat-absorbing fin member 24, a first thermoelectric chip group 29*a* and a second thermoelectric chip group 29*b*, a first support frame 32*a* and a second support frame 32*b*, a first heat-dissipating-side base 31*a* and a second heat-dissipating-side base 31*b*, a first cover member 33*a* and a second cover member 33*b*, and a first distributing member 34*a* and a second distributing member 34*b* are arranged as discrete members, respectively.

Since the heat-dissipating-side bases 31*a*,31*b* and the like are arranged as discrete members in combination with the respective thermoelectric chip groups 29*a*,29*b*, close contact can be established between the heat-absorbing fin member 24 and the thermoelectric chip groups 29*a*,29*b* and also between the thermoelectric chip groups 29*a*,29*b* and the heat-dissipating-side bases 31*a*,31*b* even if there is a difference in height between the thermoelectric chip groups 29*a*,29*b*.

A second difference resides in that, although not illustrated in the drawing, the thermoelectric module is arranged in an upper part or side part of a peripheral wall of a storage unit.

Figure 15:
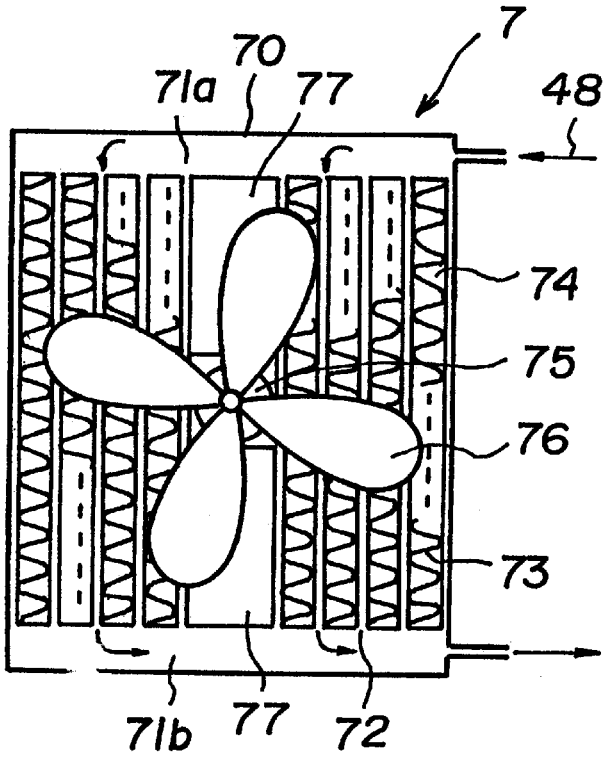
FIG. 15 is a front view of a radiator in a storage box apparatus according to a fourth embodiment of the present invention.
Figure 16:
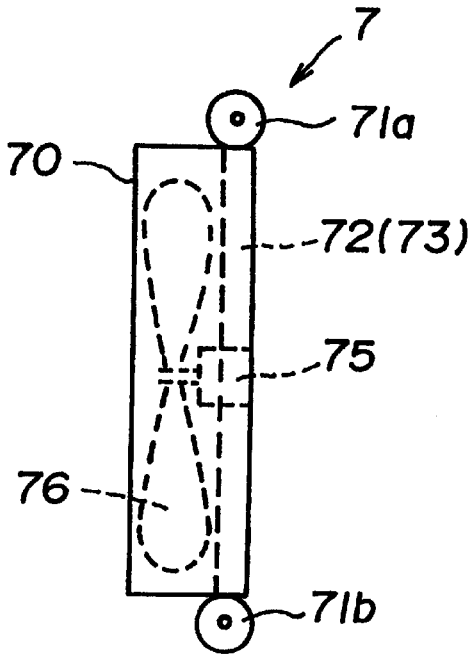
FIG. 16 is a side view of the radiator.
Figure 17:
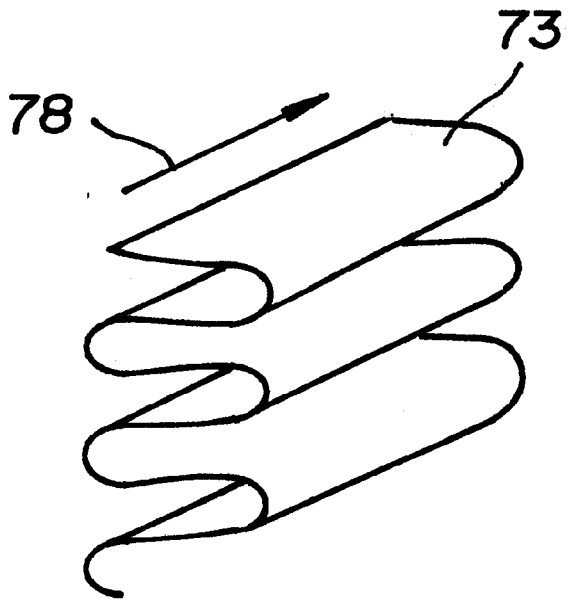
FIG. 17 is a fragmentary perspective view of a corrugated fin for use in the radiator.

Referring next to FIGS. 15 to 17, the radiator in the storage box apparatus according to the fourth embodiment of the present invention will be described.

Arranged in upper and lower parts of a casing 70 are an inlet manifold 71*a* and an outlet manifold 71*b*, each of which has a relatively large cross-sectional flow area to reduce the pressure loss. Many flattened pipes 72 are arranged side by side at predetermined intervals, extending from the inlet manifold 71*a* toward the outlet manifold 71*b*. Between each pipe 72 and its adjacent pipe 72, a corrugated fin 73 which has been formed by bending a thin metal sheet in a tortuous form as shown in FIG. 17 is inserted. The pipes 72 and the corrugated fin 73 are brazed together at areas of contact therebetween. The pipes 72 continuously extend from the inlet manifold 71*a* to the outlet manifold 71*b*, while numerous spaces 74 formed by the corrugated fins 73 continuously extend along the widths of the corresponding corrugated fins 73 (i.e., in a direction perpendicular to the drawing sheet of FIG. 15).

A drive motor 75 is accommodated in a substantially central part of the casing 70. A blade 76 which is connected to a motor shaft is arranged in front of the corrugated fins 73. The blade 76 is protected around a periphery thereof by the casing 70 (see FIG. 16) and, as is depicted in FIG. 15, blind patches 77 are arranged on upper and lower sides of the drive motor 75, respectively.

Water 48, which as flowed through the individual thermoelectric modules 4 as illustrated in FIG. 3, enters the inlet manifold 71*a* in the upper part of the casing 70, where the water is promptly distributed to the individual pipes 72. The water 48, which has flowed down through the pipes 72, is collected in the outlet manifold 71*b* in the lower part of the casing 70. By driving the blade 76, air 78 is caused to flow along surfaces of the corrugated fins 73 as shown in FIG. 17, that is, in a perpendicular direction as viewed in FIG. 15. In the course of this flow, the air efficiently chills the water 48 which is flowing through the pipes 72.

The accommodation of the drive motor 75 together with the pipes 72 and the corrugated fins 73 within the casing 70 as in this embodiment makes it possible to eliminate any partly projecting portions, so that the radiator 7 can be reduced in thickness.

Figure 18:
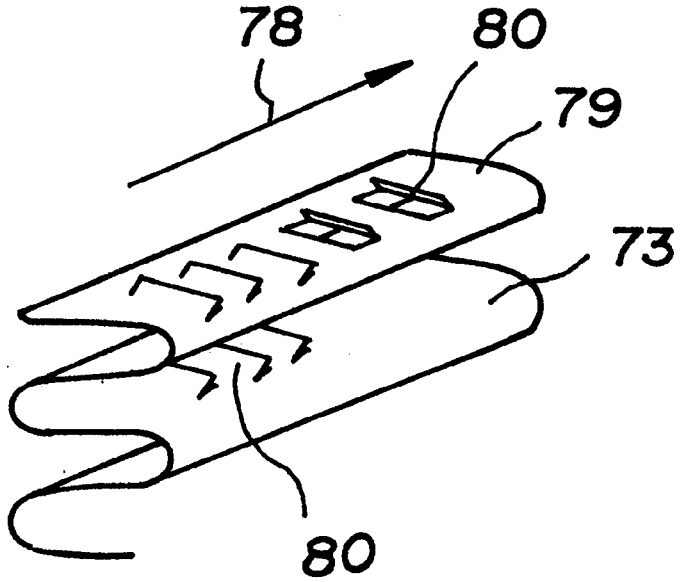
FIG. 18 is a fragmentary perspective view of a corrugated fin for use in a radiator of a storage box apparatus according to a fifth embodiment of the present invention.

With reference to FIG. 18, a description will next be made of fins employed in the thermoelectric module of the storage box apparatus according to the fifth embodiment of the present invention. Each corrugated fin 73 is provided at planar portions 79 thereof with a number of louver fins 80 which extend in a direction perpendicular to the direction of a flow of air 78, whereby the louver fins 80 enhance cooling effects of the corrugated fin 73 for the water 48. Many through-holes may be formed in the planar portions of each corrugated fin 73 although the louver fins 80 are arranged in this embodiment.

Figure 20:
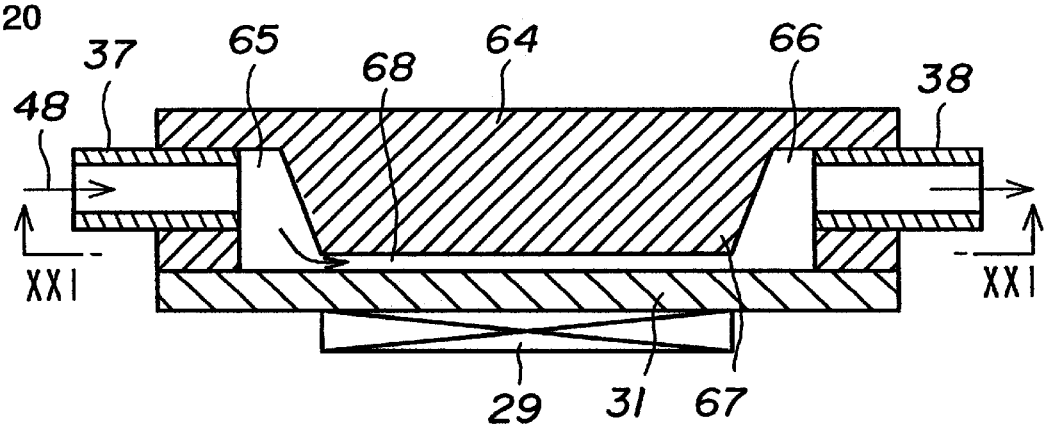
FIG. 20 is a fragmentary cross-sectional view of a thermoelectric module in a storage box apparatus according to a sixth embodiment of the present invention.
Figure 21:
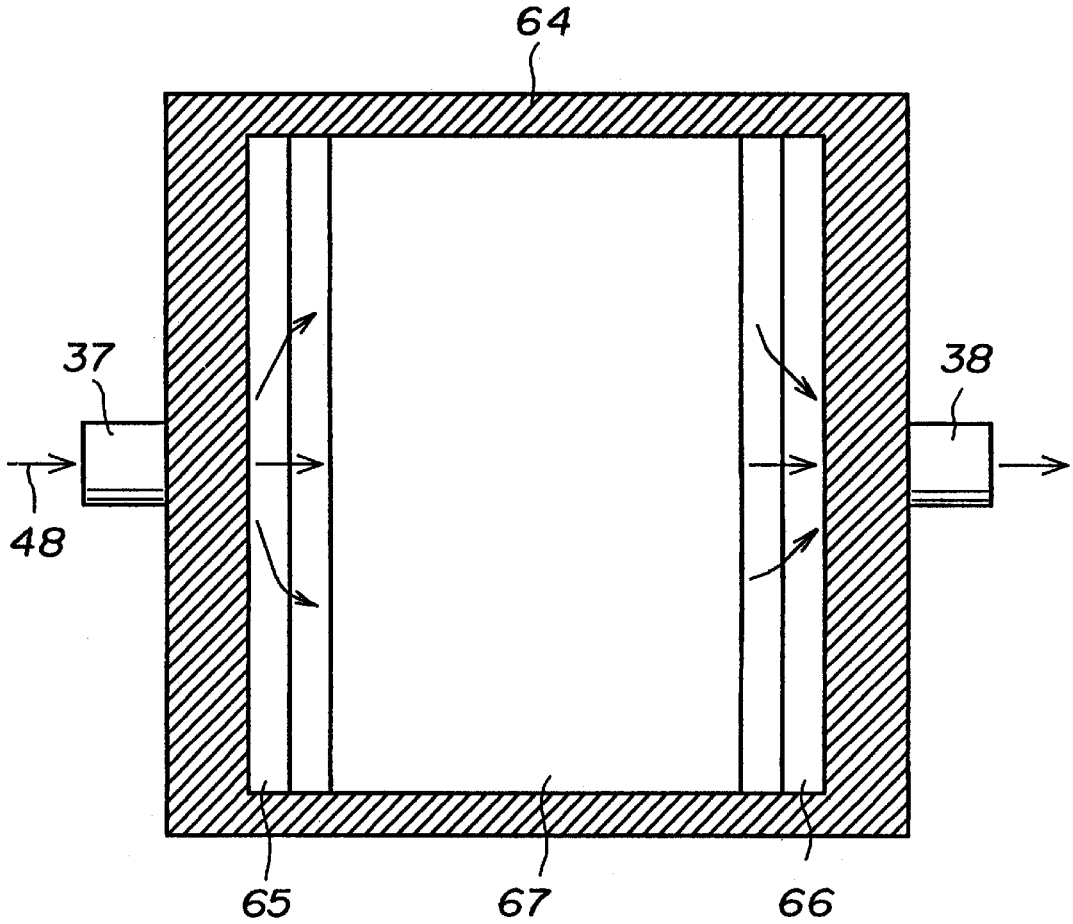
FIG. 21 is a cross-sectional view of the thermoelectric module in the storage box apparatus, taken in the direction of arrows XXI—XXI of FIG. 20.

With reference to FIGS. 20 and 21, the thermoelectric module in the storage box apparatus according to the sixth embodiment of the present invention will hereinafter be described. In this embodiment, a jacket casing 64 which is secured in a liquid-tight fashion on a heat-dissipating-side base 31 is provided with a supply pipe 37 and a drain pipe 38. On a side of the supply pine 37, a water-spreading channel 65 having a large cross-sectional flow area is formed in the direction of the width of the jacket casing 64, and on a side of the drain pipe 38, a water-collecting channel 66 having a large cross-sectional flow area is formed. Between the water-spreading channel 65 and the water-collecting channel 66, a bulged portion 67 is arranged extending toward the heat-dissipating-side base 31. By this bulged portion 67, a narrow clearance gap 68 having an area substantially the same as or smaller than the heat-dissipating-side base 31 is formed between the bulged portion 67 and the heat-dissipating-side base 31.

The water 48, which has been supplied from the inlet pipe 37 into the jacket casing 64, spreads at once in the widthwise direction within the water-spreading channel 65 as shown in FIG. 21 and then flows at a high velocity along a surface of the heat-dissipating-side base 31 through the narrow clearance gap 68. By causing the water 48 to flow at a high velocity along the surface of the heat-dissipating-side base 31 as described above, a boundary layer which is formed on and along the surface of the heat-dissipating-side base 31 can be rendered thinner as much as possible, leading to an increased thermal conductance and hence to enhanced heat-dissipating effects. The water 48 which has passed through the clearance gap 68 is collected in the water-collecting channel 66 and is then drained through the drain pipe 38. It is possible to reduce the pressure loss by forming the water-spreading channel 65 and the water-collecting channel 66, each of which is large in cross-sectional flow area, in the jacket casing 64 as described above.

Figure 22:
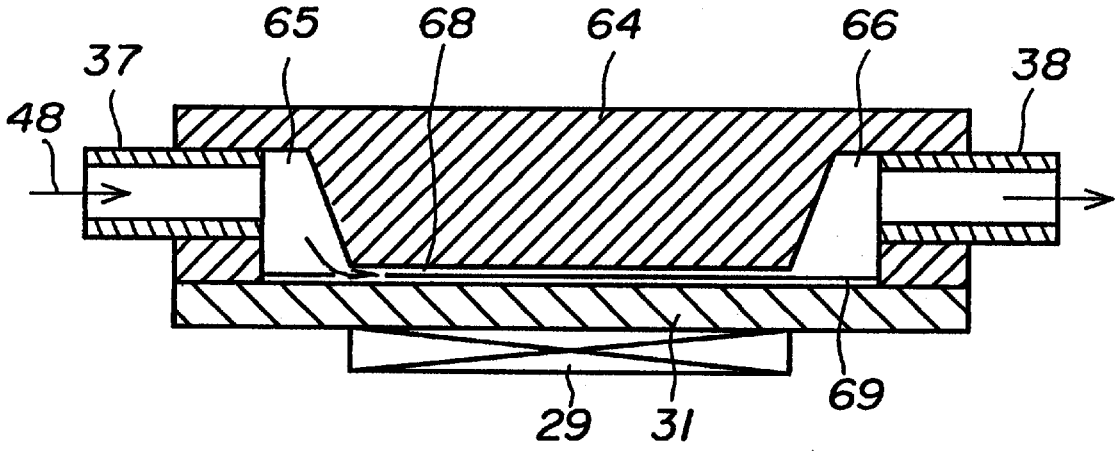
FIG. 22 is a fragmentary cross-sectional view of a thermoelectric module in a storage box apparatus according to a seventh embodiment of the present invention.
Figure 2:
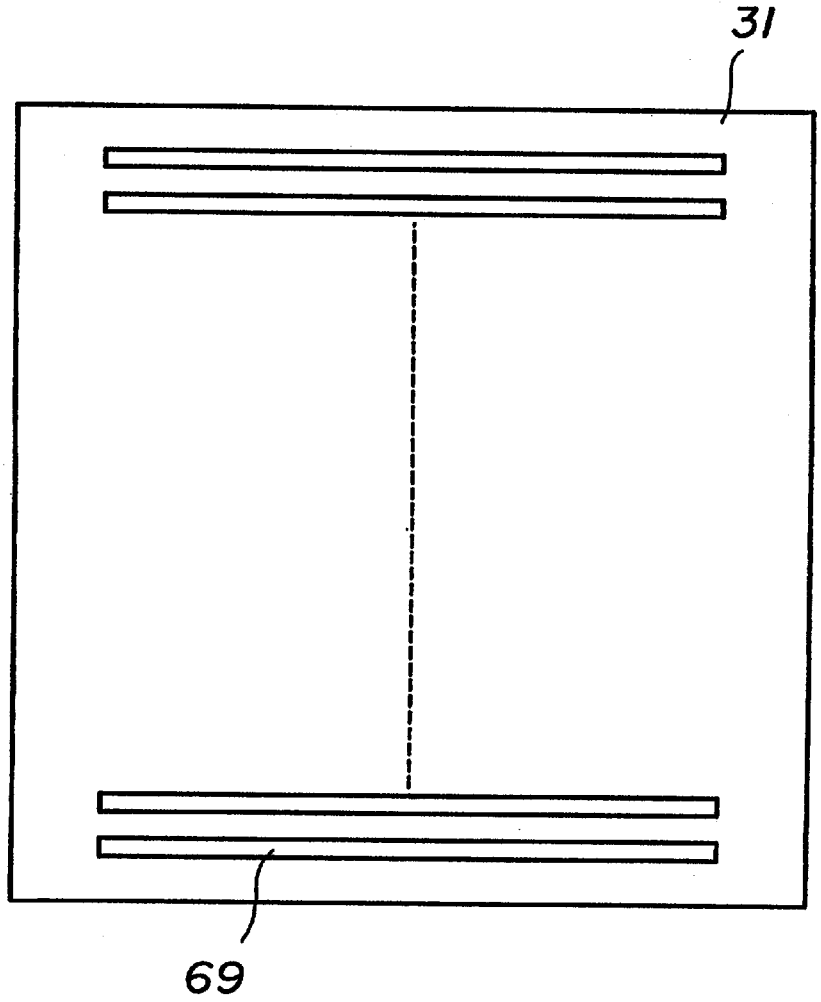

Referring next to FIGS. 22 and 23, a description will be made about the thermoelectric module in the storage box apparatus according to the seventh embodiment of the present invention and also about the heat-dissipating-side base 31 employed in the thermoelectric module. This embodiment is different from the sixth embodiment in that on the flat surface of the heat-dissipating-side base 31, many ridges 69 are formed extending in the direction of the flow of the water 48 as depicted in FIG. 23. The heat-dissipating effect can be enhanced further by forming the ridges 69 in a large number on the flat surface of the heat-dissipating-side base 31 as described above.

Figure 24:
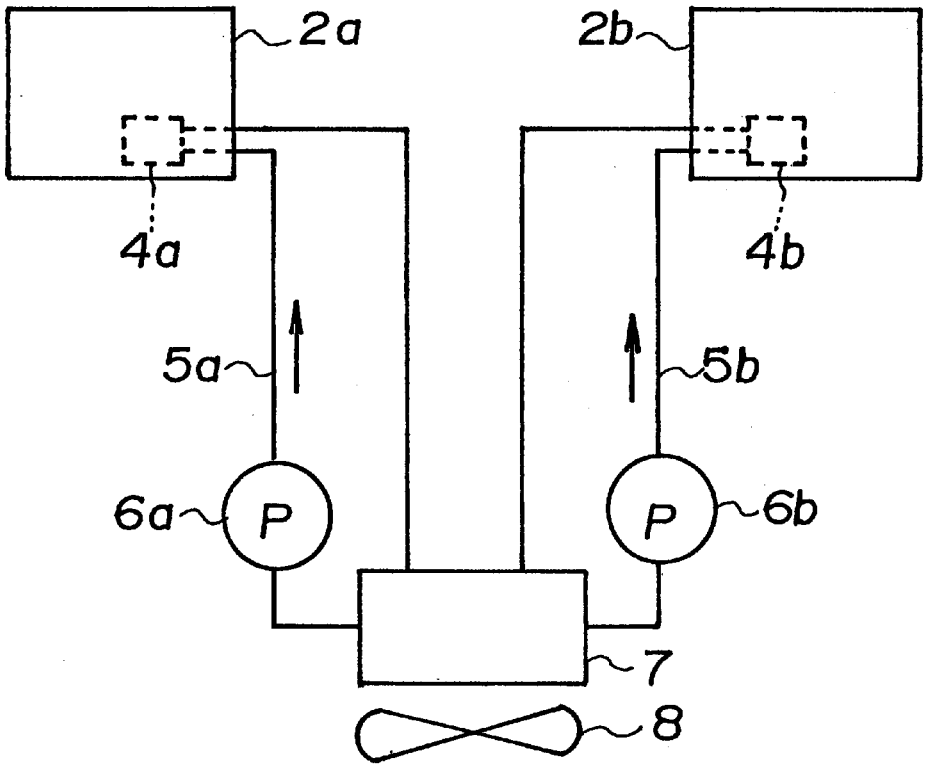
FIG. 24 is a schematic construction diagram of a storage box apparatus according to an eighth embodiment of the present invention.

With reference to FIG. 24, the storage box apparatus according to the eighth embodiment of the present invention will hereinafter be described. According to the first embodiment illustrated in FIG. 3, the thermoelectric modules 4 which are arranged in the respective storage units 2*a*–2*d*, respectively were connected together by the single water-distributing pipe 5 so that a single large recirculation system was constructed. In this embodiment, on the other hand, plural recirculation systems are arranged, which comprise plural water-distributing pipes 5*a*,5*b* and plural recirculating pumps 6*a*,6*b*, respectively, and one or plural thermoelectric modules 4*a* or 4*b* are connected to each of the recirculation systems. A radiator 7 and a fan 8, which are both arranged at a point of connection between the water-distributing pipes 5*a*,5*b*, are also used commonly in this embodiment. Although not shown in the drawing, a water flow passage for the water-distributing pipe 5*a* and a water flow passage for the water-distributing pipe 5*b* within the radiator 7 are separated.

When the recirculation velocity of water is changed depending on whether the storage unit 2 is used for refrigerated storage or for frozen storage, the storage box apparatus according to this embodiment is suited.

Figure 25:
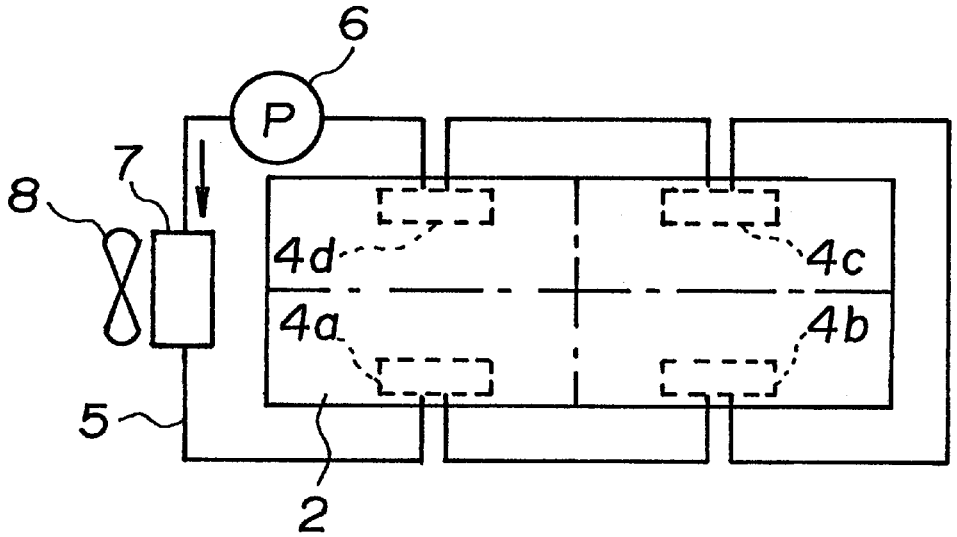
FIG. 25 is a simplified construction diagram of a storage box apparatus according to a ninth embodiment of the present invention.
Figure 26:
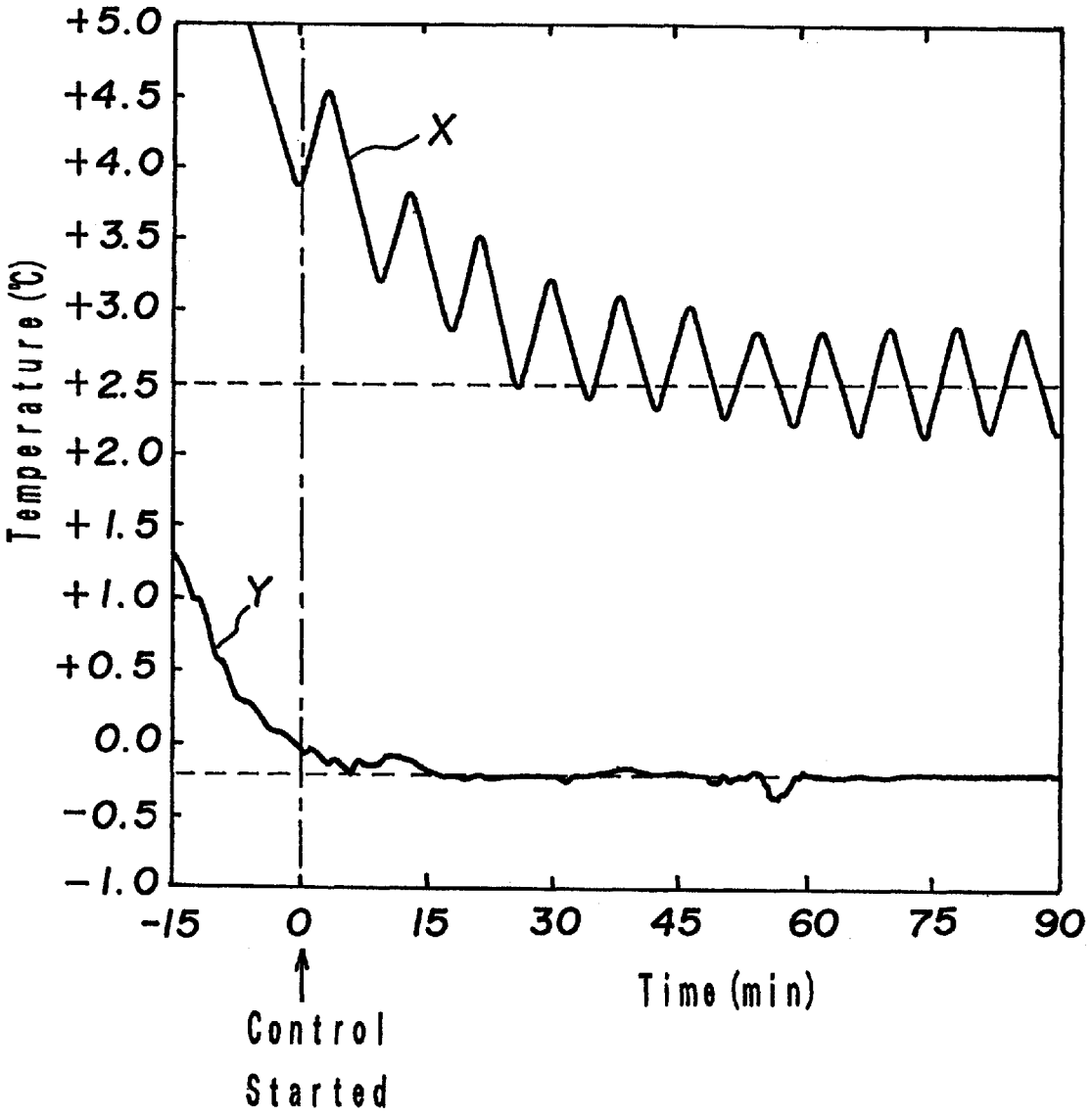
FIG. 26 is a diagram showing cooling characteristics of a storage box apparatus of the flon/compressor type and those of a storage box apparatus making use of a thermoelectric module.

Referring next to FIG. 25, the storage box apparatus according to the ninth embodiment of the present invention will be described. This embodiment is suited for a large storage unit 2 which is equipped with a large storage space. For the single storage unit 2, plural thermoelectric modules 4*a*–4*d* are arranged at equal intervals in the whole storage space. The individual thermoelectric modules 4*a*–4*d* are connected together by a single water-distributing pipe 5, whereby a radiator 7 and a fan 8 are commonly used. This construction makes it possible to narrow the temperature distribution inside the large storage unit 2 and thus to perform precise temperature control. Incidentally, the interior of the storage unit 2 can be hermetically divided as needed as indicated by a phantom.

Incidentally, the heat-dissipating effects are reduced if gas such as air accumulates in a heat-dissipating jacket making use of a heat transfer medium such as water as in the above-described embodiment. It is therefore desired to discharge the gas together with the heat transfer medium by arranging a gas discharge device, by making a drain side somewhat higher than a supply side when the heat-dissipating jacket is arranged in a horizontal position or by disposing a drain side on an upper side when the jacket is arranged in a vertical position.

Upon refrigeration or freezing of contents, a heat storage material which has been cooled in advance by using night-rate electric power can be used in combination.

As a power source for the thermoelectric module or modules, it is possible to use a battery such as a solar battery or to use main power in combination with a battery.

It is also possible to arrange a sensor such as an infrared light sensor or a load sensor within a storage unit for the detection of the presence or absence of a package in the storage unit so that the power supply can be on/off-controlled by a detection signal from the sensor.

In the case of a storage box apparatus including plural storage units combined together, a like plural number of wattmeters or a single wattmeter can be arranged for recording electric powers used by the individual storage units or electric power used by the entire combination of the storage units.

Further, temperatures during use can be recorded per the individual storage units, and the records can be indicated by a printer or another indication device as needed.

In addition, a self-diagnosing function can be provided so that, before the storage unit is used, its control system for the thermoelectric module and its recirculation system for a heat transfer medium can be diagnosed in functions.

Each of the above-described embodiments was described assuming that it was used for refrigerated storage or (and) frozen storage. The storage box apparatus according to the present invention can also be used to keep contents warm. In the case of warm storage, it is only necessary to make the flowing direction of a current to the thermoelectric module opposite to that for the case of refrigerated storage (frozen storage). In the case of warm storage, the heat-absorbing side and the heat-dissipating side are reversed, for example, a heat-absorbing fan v. the (blower) fan, heated air v. chilled air, and hearing fins v. heat-absorbing fins.

Accordingly, the storage box apparatus according to the present invention can be used in various ways, thereby permitting desired combinations such as refrigerated storage/frozen storage, refrigerated storage/refrigerated storage of different preset temperatures, refrigerated storage/warm storage, frozen storage/warm storage, warm storage/warm storage of different temperatures, and refrigerated storage/frozen storage/warm storage.

Figure 19:
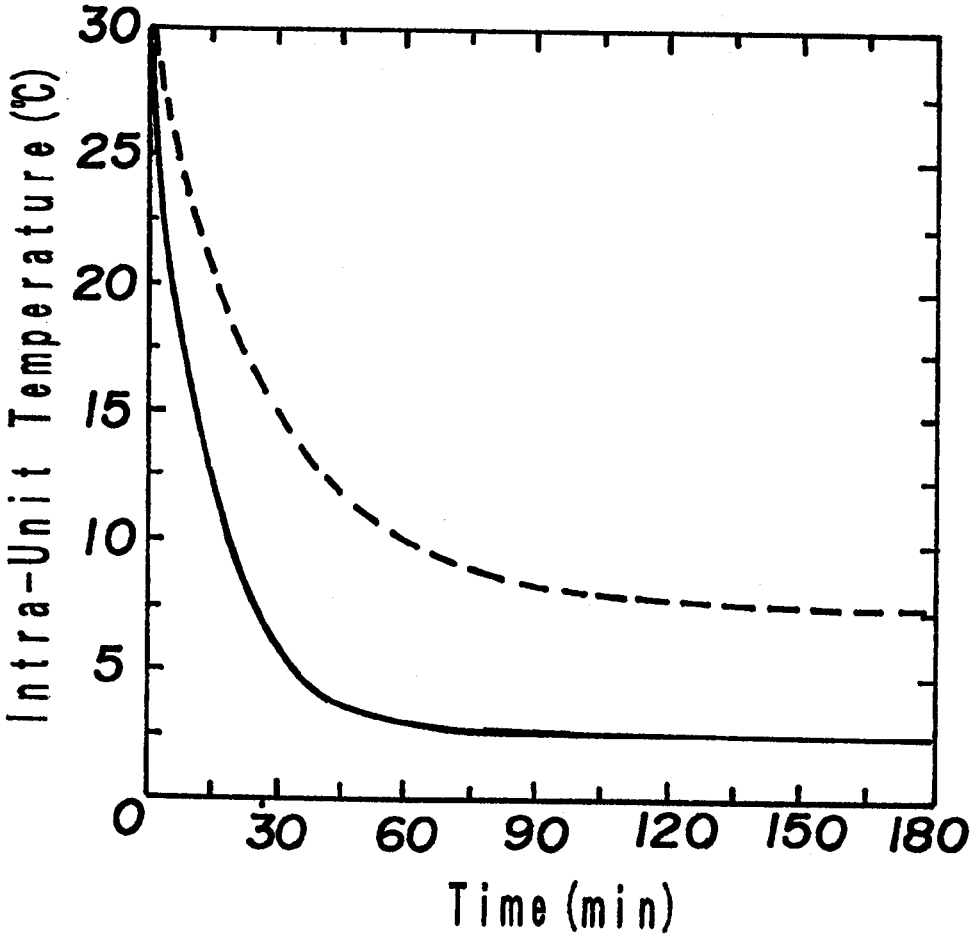
FIG. 19 is a diagram showing cooling characteristics of the storage unit in the storage box apparatus according to the first embodiment of the present invention and those of a storage unit in a conventional storage box apparatus.

Referring finally to FIG. 19, a description will be made about cooling characteristics (solid line) of the storage unit in the storage box apparatus according to the first embodiment of the present invention and those (dashed line) of a storage unit of the air-cooled type. Both storage units were tested under the following conditions: interior capacity, 64 liters; heat barrier thickness, 30 mm; and external air temperature, 30° C. Further, electric power supplied to the storage unit of the air-cooled type was 118 W, while that supplied to the storage unit in the storage box apparatus according to the first embodiment was 68 W.

As is clearly envisaged from the diagram, the temperature inside the conventional storage unit of the air-cooled type (dashed line) dropped only to 7.5° C. due to the high external air temperature despite the supply of the large electric power. At such a high interior temperature, the freshness of foods will be lowered significantly. In contrast, the temperature inside the unit according to the present invention dropped to 2.5° C. in a short time, thereby assuring maintenance of freshness.

What is claimed is:

1. A storage box apparatus making use of a thermoelectric module as a device for cooling or heating a storage unit, wherein said thermoelectric module comprises:

a cover member having a peripheral wall, said cover member defining an opening on a side thereof and being closed on an opposite side thereof;

a thermally conductive base closing said opening of said cover member;

a distributing member accommodated inside said cover member and provided with a number of jet nozzles extending toward said thermally conductive base and also with a peripheral wall portion;

a group of thermoelectric chips arranged in close contact with a first surface of said thermally conductive base, said first surface being an a side opposite to said cover member;

a supply pipe arranged in communication with a first space formed between said cover member and said distributing member;

a drain pipe arranged in communication with a second space formed between said thermally conductive base and said distributing member; and a heat transfer medium comprising water or antifreeze; whereby said heat transfer medium supplied into said first space through said supply pipe is spouted against a second surface of said base, thermally conductive said surface being on a side of said cover member, at a right angle through said jet nozzles and subsequent to absorption of heat from said group of thermoelectric hips via said thermally conductive base said heat transfer medium is discharged through said drain pipe by way of said second space.

2. A storage box apparatus according to claim 1, wherein said thermoelectric module is provided with a group of heat-absorbing-side thermoelectric chips and a group of heat-dissipating-side thermoelectric chips, said heat-absorbing-side thermoelectric chip group and said heat-dissipating-side thermoelectric chip group have cascade structures, and said heat-absorbing-side thermoelectric chip group and said heat-dissipating-side thermoelectric chip group are supplied with currents of different current densities, respectively.

3. A storage box apparatus according to claim 2, wherein said heat-absorbing-side thermoelectric chip group and said heat-dissipating-side thermoelectric chip group are identical to each other in the dimension and number of chips used therein.

4. A storage box apparatus according to claim 1, wherein said heat transfer medium is jetted through nozzle portions which extend close to said surface of said thermally conductive base.

5. A storage box apparatus according to claim 4, wherein said let nozzles form, in vicinities of root portions thereof, escape concavities for allowing said heat transfer medium, which has struck said thermally conductive base, to escape from said surface of said thermally conductive base.

6. A storage box apparatus according to claim 1, wherein said thermally conductive base is provided with concavities at positions facing said nozzle portions, respectively.

7. A storage box apparatus according to claim 1, wherein said jet nozzles form, in vicinities of root portions thereof, escape concavities for allowing said heat transfer medium, which has struck said thermally conductive base, to escape from said surface of said thermally conductive base.

8. A storage box apparatus according to claim 1, wherein said thermoelectric module is provided with a heat-absorbing fin member having fins, and said heat-absorbing fin member is covered over opposite sides thereof and an upper side thereof so that air inside said storage unit flows between said fins.

9. A storage box apparatus according to claim 1, wherein spacers are arranged on a contents-mounting wall or an inner side wall of said storage unit so that spaces are formed between said contents-mounting wall or said inner side wall and contents of said storage unit for allowing air to flow therethrough.

10. A storage box apparatus comprising a storage unit assembly constructed of a number of storage units, thermoelectric modules as devices for cooling or heating interiors of said storage units, respectively, and a single operation control unit arranged outside said storage unit assembly for operating said individual thermoelectric modules, wherein said single operation control unit is replaceably arranged relative to said control unit assembly.

11. A storage box apparatus comprising a storage unit assembly constructed of a number of storage units, thermoelectric modules as devices for cooling or heating interiors of said storage units, respectively, and a single operation control unit arranged outside said storage unit assembly for operating said individual thermoelectric modules, wherein temperatures of said individual storage units can be set independently by said single operation control unit.

* * * * *